US008662837B2

(12) United States Patent
Marini

(10) Patent No.: US 8,662,837 B2
(45) Date of Patent: Mar. 4, 2014

(54) HP TURBINE VANE AIRFOIL PROFILE

(75) Inventor: Remo Marini, Montreal (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 611 days.

(21) Appl. No.: 13/011,158

(22) Filed: Jan. 21, 2011

(65) Prior Publication Data

US 2011/0229317 A1 Sep. 22, 2011

Related U.S. Application Data

(60) Provisional application No. 61/296,900, filed on Jan. 21, 2010.

(51) Int. Cl.
*F01D 9/02* (2006.01)

(52) U.S. Cl.
USPC ..... 415/191; 415/211.2; 416/223 A

(58) Field of Classification Search
USPC ..... 415/191, 211.2; 416/223 A
See application file for complete search history.

(56) References Cited

U.S. PATENT DOCUMENTS

| | | | |
|---|---|---|---|
| 6,398,489 | B1 | 6/2002 | Burdgick et al. |
| 6,832,897 | B2 | 12/2004 | Urban |
| 6,854,961 | B2 | 2/2005 | Zhang et al. |
| 6,910,868 | B2 | 6/2005 | Hyde et al. |
| 7,306,436 | B2 | 12/2007 | Girgis et al. |
| 7,351,038 | B2 | 4/2008 | Girgis et al. |
| 7,354,249 | B2 | 4/2008 | Girgis et al. |
| 7,367,779 | B2 | 5/2008 | Girgis et al. |
| 7,402,026 | B2 | 7/2008 | Girgis et al. |
| 7,520,726 | B2 | 4/2009 | Papple et al. |
| 7,520,727 | B2 | 4/2009 | Sreekanth et al. |
| 7,520,728 | B2 | 4/2009 | Sleiman et al. |
| 7,534,091 | B2 | 5/2009 | Ravanis et al. |
| 7,537,432 | B2 | 5/2009 | Marini et al. |
| 7,537,433 | B2 | 5/2009 | Girgis et al. |
| 7,559,746 | B2 | 7/2009 | Tsifourdaris et al. |
| 7,559,747 | B2 | 7/2009 | Mohan et al. |
| 7,559,748 | B2 | 7/2009 | Kidikian et al. |
| 7,559,749 | B2 | 7/2009 | Kidikian et al. |
| 7,566,200 | B2 | 7/2009 | Marini et al. |
| 7,568,889 | B2 | 8/2009 | Mohan et al. |
| 7,568,890 | B2 | 8/2009 | Findlay et al. |
| 7,568,891 | B2 | 8/2009 | Mohan et al. |
| 7,611,326 | B2 | 11/2009 | Trindade et al. |
| 7,625,182 | B2 | 12/2009 | Mah et al. |
| 7,625,183 | B2 | 12/2009 | Tsifourdaris et al. |
| 7,632,074 | B2 | 12/2009 | Ravanis et al. |
| 2005/0079061 | A1 | 4/2005 | Beddard |
| 2008/0124219 | A1 | 5/2008 | Kidikian et al. |

(Continued)

OTHER PUBLICATIONS

U.S. Appl. No. 12/732,708, filed Mar. 26, 2010, Tsifourdaris.

(Continued)

*Primary Examiner* — Edward Look
*Assistant Examiner* — Jesse Prager
(74) *Attorney, Agent, or Firm* — Norton Rose Fulbright Canada LLP

(57) ABSTRACT

A two-stage high pressure turbine includes a second stage vane having an airfoil with a profile substantially in accordance with at least an intermediate portion of the Cartesian coordinate values of X, Y and Z set forth in Table 2. The X and Y values are distances, which when smoothly connected by an appropriate continuing curve, define airfoil profile sections at each distance Z. The profile sections at each distance Z are joined smoothly to one another to form a complete airfoil shape.

12 Claims, 4 Drawing Sheets

(56) References Cited

U.S. PATENT DOCUMENTS

| | | | |
|---|---|---|---|
| 2009/0097982 | A1 | 4/2009 | Saindon et al. |
| 2009/0116967 | A1 | 5/2009 | Sleiman et al. |
| 2010/0008784 | A1 | 1/2010 | Shafique et al. |

OTHER PUBLICATIONS

U.S. Appl. No. 12/749,779, filed Mar. 30, 2010, Marini.
U.S. Appl. No. 12/752,271, filed Apr. 1, 2010, Marini.
U.S. Appl. No. 12/752,404, filed Apr. 1, 2010, Tsifourdaris.
U.S. Appl. No. 12/749,841, filed Mar. 30, 2010, Tsifourdaris.
U.S. Appl. No. 12/766,329, filed Apr. 23, 2010, Marini et al.

HP TURBINE VANE AIRFOIL PROFILE

CROSS-REFERENCE TO RELATED APPLICATION

The present application claims priority on U.S. Provisional Application No. 61/296,900 filed on Jan. 21, 2010, the content of which is incorporated herein by reference.

TECHNICAL FIELD

The application relates generally to a vane airfoil for a gas turbine engine and, more particularly, to an airfoil profile suited for use in the second stage vane assembly of a high pressure turbine.

BACKGROUND OF THE ART

Every stage of a gas turbine engine must meet a plurality of design criteria to assure the best possible overall engine efficiency. The design goals dictate specific thermal and mechanical requirements that must be met pertaining to heat loading, parts life and manufacturing, use of combustion gases, throat area, vectoring, the interaction between stages to name a few. The design criteria for each stage is constantly being re-evaluated and improved upon. Each airfoil is subject to flow regimes which lend themselves easily to flow separation, which tend to limit the amount of work transferred to the compressor, and hence the total thrust or power capability of the engine. The high pressure turbine is also subject to harsh temperatures and pressures, which require a solid balance between aerodynamic and structural optimization. Therefore, improvements in airfoil design are sought.

SUMMARY OF THE INVENTION

In one aspect, there is provided a turbine vane for a gas turbine engine comprising an airfoil having an intermediate portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, there is provided a turbine vane for a gas turbine engine, the turbine vane having a cold coated intermediate airfoil portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, there is provided a turbine stator assembly for a gas turbine engine comprising a plurality of vanes, each vanes including an airfoil having an intermediate portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In a still further aspect, there is provided a high pressure turbine vane comprising at least one airfoil having a surface lying substantially on the points of Table 2, the airfoil extending between platforms defined generally by some of the coordinates given in Table 1, wherein a fillet radius is applied around the airfoil between the airfoil and platforms, and wherein the values of Table 2 are subject to the relevant tolerance.

DESCRIPTION OF THE DRAWINGS

Reference is now made to the accompanying figures in which.

DETAILED DESCRIPTION

Figure 1:
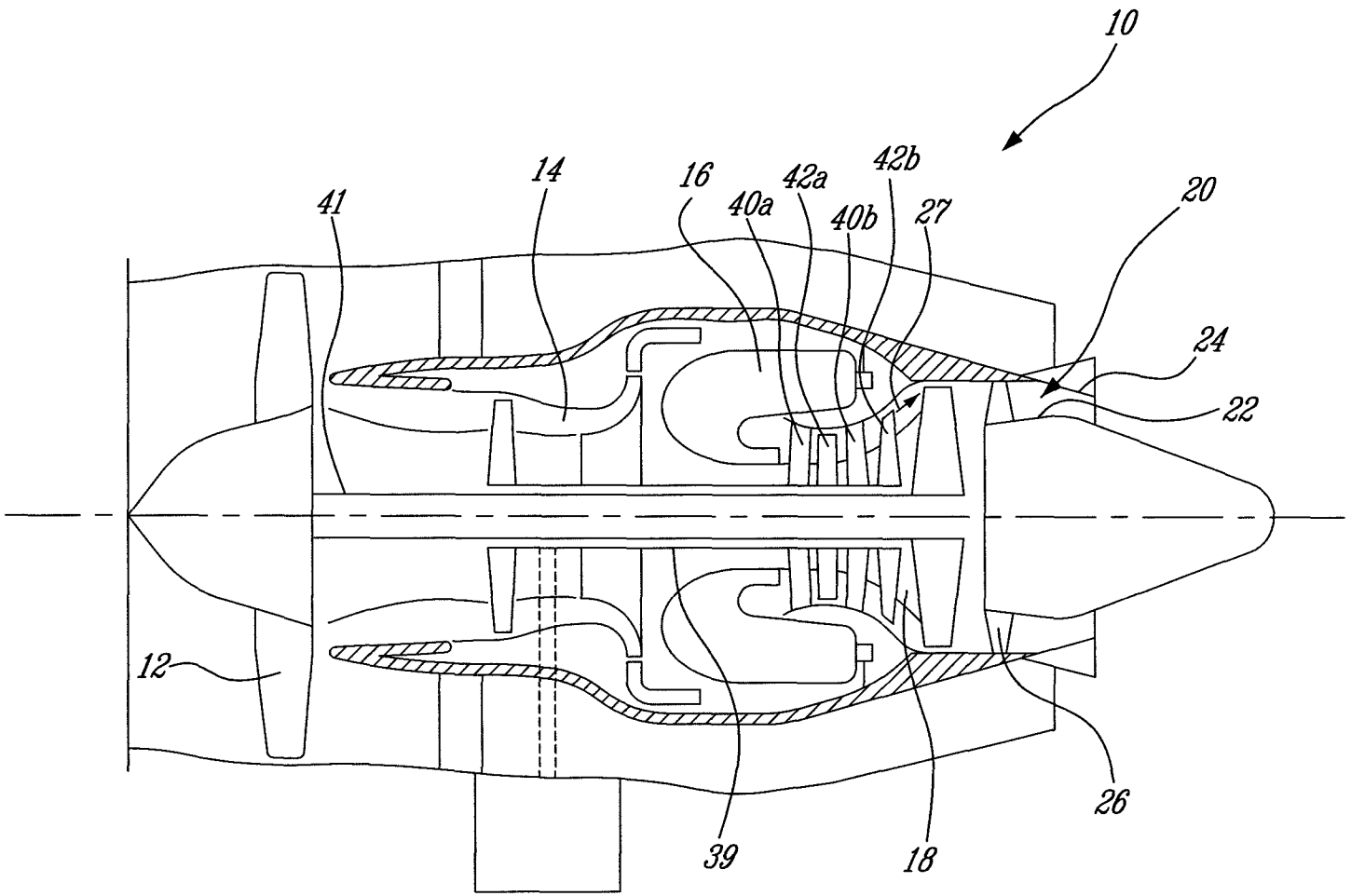
FIG. 1 is a schematic view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases to drive the fan, the compressor, and produce thrust.

The gas turbine engine 10 further includes a turbine exhaust duct 20 which is exemplified as including an annular core portion 22 and an annular outer portion 24 and a plurality of struts 26 circumferentially spaced apart, and radially extending between the inner and outer portions 22, 24.

Figure 2:
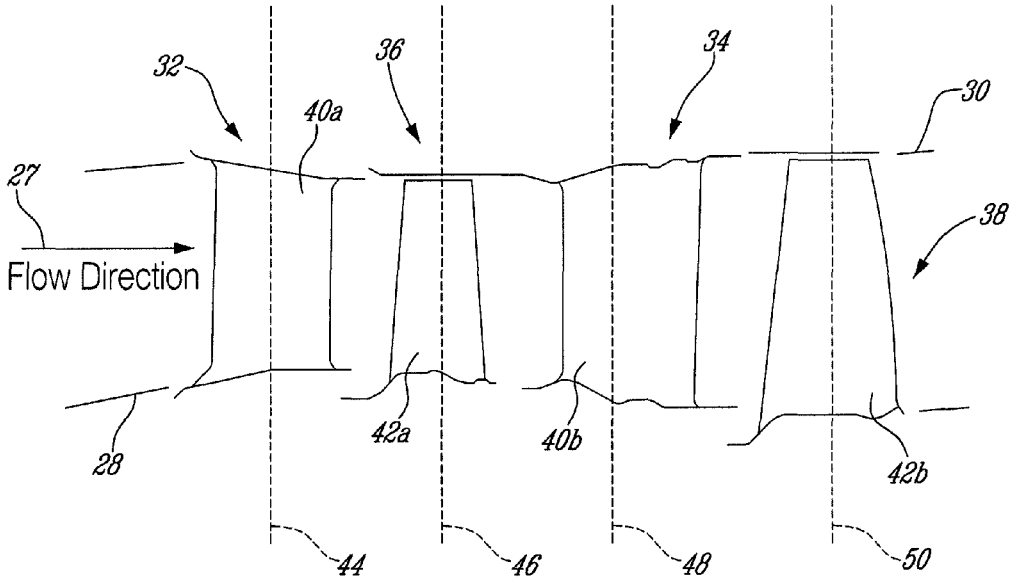
FIG. 2 is a schematic view of a gaspath of the gas turbine engine of FIG. 1, including a two-stage high pressure turbine.
Figure 2:
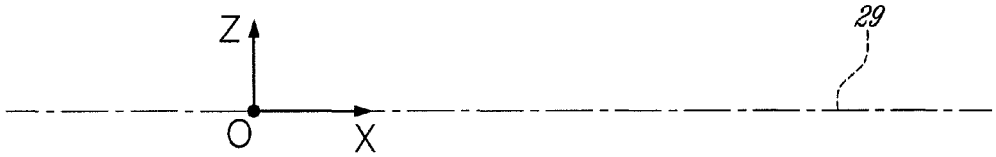

FIG. 2 illustrates a portion of an annular hot gaspath, indicated by arrows 27 and defined by annular inner and outer walls 28 and 30 respectively, for directing the stream of hot combustion gases axially in an annular flow. The profile of the inner and outer walls 28 and 30 of the annular gaspath, "cold" (i.e. non-operating) conditions, is defined by the Cartesian coordinate values such as the ones given in Table 1 below. More particularly, the inner and outer gaspath walls 28 and 30 are defined with respect to mutually orthogonal x and z axes, as shown in FIG. 2. The x axis corresponds to the engine turbine rotor centerline 29. The radial distance of the inner and outer walls 28 and 30 from the engine turbine rotor centerline and, thus, from the x-axis at specific axial locations is measured along the z axis. The z values provide the inner and outer radius of the gas path at various axial locations therealong. The x and z coordinate values in Table 1 are distances given in inches from the point of origin O (see FIG. 2). It is understood that other units of dimensions may be used. The x and z values have in average a manufacturing tolerance of about ±0.030". The tolerance may account for such things as casting, coating, ceramic coating and/or other tolerances. It is understood that the manufacturing tolerances of the gas path may vary along the length thereof.

The turbine section 18 has two high pressure turbine (HPT) stages located in the gaspath 27 downstream of the combustor 16. Referring to FIG. 2, the HPT stages each comprises a stator assembly 32, 34 and a rotor assembly 36, 38 having a plurality of circumferentially arranged vane 40*a*, 40*b* and blades 42*a*, 42*b* respectively. The vanes 40*a,b* and blades 42*a,b* are mounted in position along respective stacking lines 44-50, as identified in FIG. 2. The stacking lines 44-50 extend in the radial direction along the z axis at different axial locations. The stacking lines 44-50 define the axial location where the blades and vanes of each stage are mounted in the engine 10. More specifically, stacking line 44 located at x=0 corresponds to the first stage HPT vane 40*a*. The stacking line 48 of the second stage HP turbine vane 40*b* is located at x=2.812 Table 1 provides gaspath definition from upstream to downstream of the second stage HP vane airfoil 40*b*.

TABLE 1

COLD GASPATH DEFINITION

| INNER GASPATH | | OUTER GASPATH | |
|---|---|---|---|
| X | Z | X | Z |
| 1.348 | 6.775 | 1.517 | 8.307 |
| 1.506 | 6.715 | 1.673 | 8.307 |
| 1.670 | 6.702 | 1.828 | 8.307 |
| 1.834 | 6.681 | 1.984 | 8.307 |
| 2.050 | 6.650 | 2.037 | 8.313 |
| 2.322 | 6.686 | 2.296 | 8.253 |
| 2.550 | 6.667 | 2.554 | 8.311 |
| 2.757 | 6.550 | 2.812 | 8.377 |
| 2.984 | 6.574 | 3.076 | 8.383 |
| 3.277 | 6.511 | 3.331 | 8.435 |
| 3.526 | 6.497 | 3.592 | 8.451 |
| 3.807 | 6.497 | 3.858 | 8.455 |
| 3.830 | 6.202 | 3.896 | 8.486 |
| 3.984 | 6.281 | 4.052 | 8.486 |
| 4.144 | 6.420 | 4.207 | 8.486 |
| 4.363 | 6.441 | 4.362 | 8.486 |
| 4.583 | 6.440 | 4.518 | 8.486 |

Figure 3:
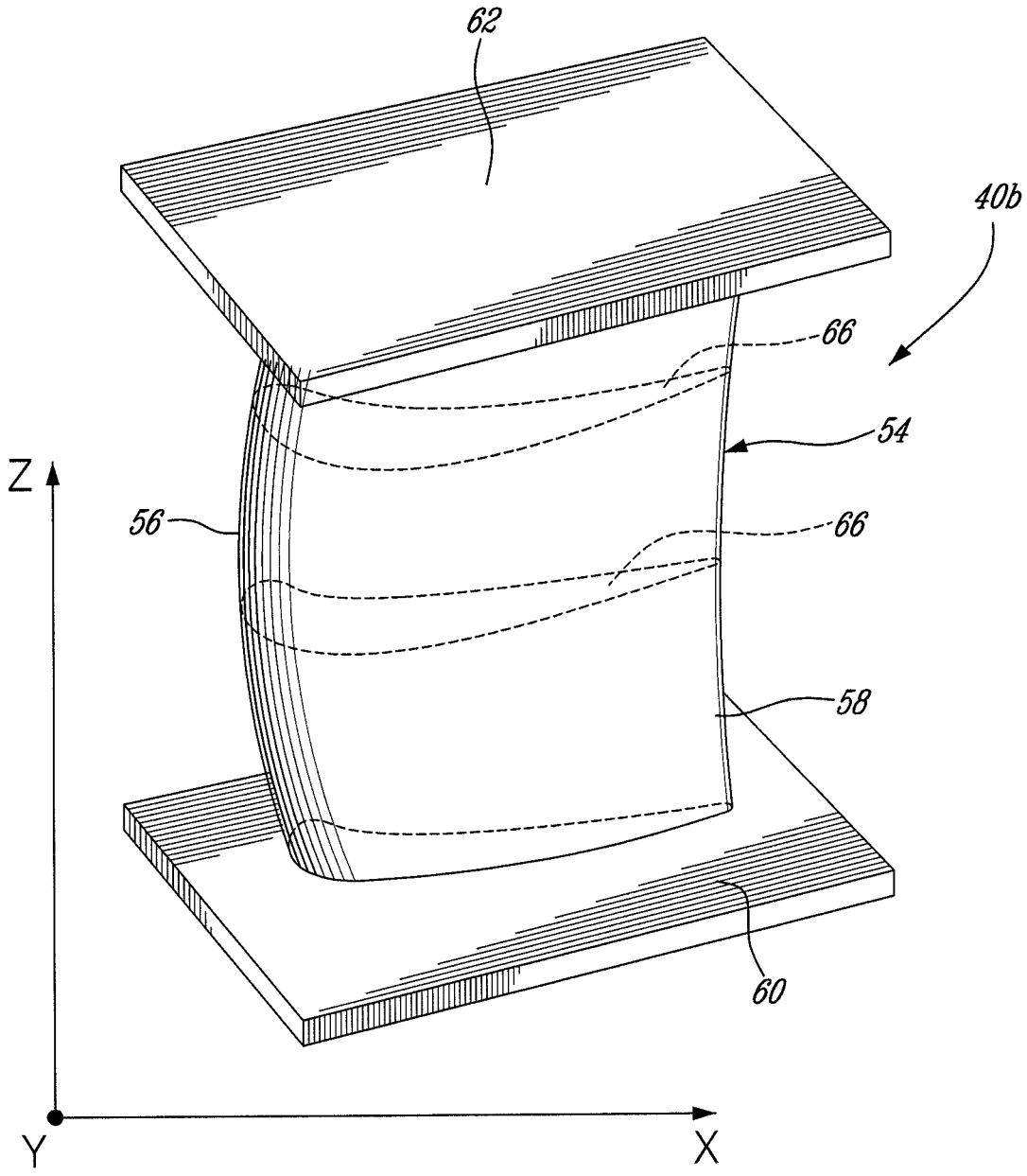
FIG. 3 is a schematic elevation view of a high pressure turbine (HPT) stage vane having a vane profile defined in accordance with an embodiment of the present invention.

More specifically, the stator assemblies 32, 34 each include the plurality of circumferentially distributed vanes 40*a* and 40*b* respectively which extend radially across the hot gaspath 27. FIG. 3 shows an example of a vane 40*b* of the second HPT stage. It can be seen that each vane 40*b* has an airfoil 54 having a leading edge 56 and a trailing edge 58, extending between inner vane platform 60 and outer vane platform 62. The inner and outer vane platforms form parts of the above cold gaspath definition of the inner and outer gaspaths, respectively.

The novel airfoil shape of each second stage HPT vane 40*b* is defined by a set of X-Y-Z points in space. This set of points represents a novel and unique solution to the target design criteria discussed above, and are well-adapted for use in a two-stage high pressure turbine design. The set of points are defined in a Cartesian coordinate system which has mutually orthogonal X, Y and Z axes. The X axis extends axially along the turbine rotor centerline 29, i.e., the rotary axis. The positive X direction is axially towards the aft of the turbine engine 10. The Z axis extends along the HPT vane stacking line 48 of each respective vane 40*b* in a generally radial direction and intersects the X axis. The positive Z direction is radially outwardly toward the outer vane platform 62. The Y axis extends tangentially with the positive Y direction being in the direction of rotation of the rotor assembly 36. Therefore, the origin of the X, Y and Z axes is defined at the point of intersection of all three orthogonally-related axes: that is the point (0,0,0) at the intersection of the center of rotation of the turbine engine 10 and the stacking line 48.

In a particular embodiment of the second stage HPT vane, the set of points which define the vane airfoil profile relative to the axis of rotation of the turbine engine 10 and stacking line 48 thereof are set out in Table 2 below as X, Y and Z Cartesian coordinate values. Particularly, the vane airfoil profile is defined by profile sections 66 at various locations along its height, the locations represented by Z values. It should be understood that the Z values do not represent an actual radial height along the airfoil 54 but are defined with respect to the engine centerline. For example, if the vanes 40*b* are mounted about the stator assembly 34 at an angle with respect to the radial direction, then the Z values are not a true representation of the height of the airfoils of the vanes 40*b*. Furthermore, it is to be appreciated that, with respect to Table 2, Z values are not actually radial heights, per se, from the centerline but rather a height from a plane through the centerline—i.e. the sections in Table 2 are planar. The coordinate values are set forth in inches in Table 2 although other units of dimensions may be used when the values are appropriately converted.

Thus, at each Z distance, the X and Y coordinate values of the desired profile section 66 are defined at selected locations in a Z direction normal to the X, Y plane. The X and Y coordinates are given in distance dimensions, e.g., units of inches, and are joined smoothly, using appropriate curve-fitting techniques, at each Z location to form a smooth continuous airfoil cross-section. The vane airfoil profiles of the various surface locations between the distances Z are determined by smoothly connecting the adjacent profile sections 66 to one another to form the airfoil profile.

The coordinate values listed in Table 2 below represent the desired airfoil profiles in a "cold" non-operating coated condition (and at nominal restagger). However, the manufactured airfoil surface profile will be slightly different, as a result of manufacturing and applied coating tolerances. According to an embodiment of the present invention, the finished HPT vane is coated with a thermal protecting layer.

The Table 2 values are generated and shown to three decimal places for determining the profile of the HPT stage vane airfoil. However, as mentioned above, there are manufacturing tolerance issues to be addressed and, accordingly, the values for the profile given in Table 2 are for a theoretical airfoil. A profile tolerance of ±0.015 inches, measured perpendicularly to the airfoil surface is additive to the nominal values given in Table 2 below. The profile tolerance accounts for airfoil profile casting, coating and ceramic coating tolerances. The second stage HPT vane airfoil design functions well within these ranges of variation. The cold or room temperature profile (including coating) is given by the X, Y and Z coordinates for manufacturing purposes. It is understood that the airfoil may deform, within acceptable limits, once entering service.

The coordinate values given in Table 2 below provide the preferred nominal second stage HPT vane airfoil profile.

TABLE 2

| X | Y | Z |
|---|---|---|
| SECTION 1 | | |
| −0.402 | −0.351 | 5.980 |
| −0.399 | −0.355 | 5.980 |
| −0.396 | −0.358 | 5.980 |
| −0.393 | −0.362 | 5.980 |
| −0.390 | −0.365 | 5.980 |
| −0.387 | −0.368 | 5.980 |
| −0.384 | −0.372 | 5.980 |
| −0.381 | −0.375 | 5.980 |
| −0.378 | −0.378 | 5.980 |
| −0.375 | −0.381 | 5.980 |
| −0.371 | −0.384 | 5.980 |
| −0.354 | −0.399 | 5.980 |

TABLE 2-continued

| X | Y | Z |
|---|---|---|
| −0.335 | −0.412 | 5.980 |
| −0.316 | −0.423 | 5.980 |
| −0.295 | −0.432 | 5.980 |
| −0.273 | −0.439 | 5.980 |
| −0.251 | −0.444 | 5.980 |
| −0.228 | −0.446 | 5.980 |
| −0.206 | −0.445 | 5.980 |
| −0.183 | −0.442 | 5.980 |
| −0.161 | −0.437 | 5.980 |
| −0.140 | −0.430 | 5.980 |
| −0.119 | −0.420 | 5.980 |
| −0.099 | −0.409 | 5.980 |
| −0.081 | −0.396 | 5.980 |
| −0.063 | −0.382 | 5.980 |
| −0.047 | −0.366 | 5.980 |
| −0.032 | −0.349 | 5.980 |
| −0.017 | −0.332 | 5.980 |
| −0.003 | −0.314 | 5.980 |
| 0.011 | −0.296 | 5.980 |
| 0.024 | −0.278 | 5.980 |
| 0.037 | −0.259 | 5.980 |
| 0.050 | −0.240 | 5.980 |
| 0.063 | −0.222 | 5.980 |
| 0.076 | −0.203 | 5.980 |
| 0.089 | −0.184 | 5.980 |
| 0.102 | −0.166 | 5.980 |
| 0.114 | −0.147 | 5.980 |
| 0.127 | −0.128 | 5.980 |
| 0.140 | −0.110 | 5.980 |
| 0.153 | −0.091 | 5.980 |
| 0.166 | −0.072 | 5.980 |
| 0.179 | −0.054 | 5.980 |
| 0.192 | −0.035 | 5.980 |
| 0.205 | −0.016 | 5.980 |
| 0.218 | 0.002 | 5.980 |
| 0.230 | 0.021 | 5.980 |
| 0.243 | 0.040 | 5.980 |
| 0.256 | 0.059 | 5.980 |
| 0.268 | 0.078 | 5.980 |
| 0.280 | 0.097 | 5.980 |
| 0.292 | 0.116 | 5.980 |
| 0.304 | 0.135 | 5.980 |
| 0.316 | 0.155 | 5.980 |
| 0.328 | 0.174 | 5.980 |
| 0.339 | 0.194 | 5.980 |
| 0.350 | 0.214 | 5.980 |
| 0.361 | 0.233 | 5.980 |
| 0.372 | 0.253 | 5.980 |
| 0.383 | 0.273 | 5.980 |
| 0.393 | 0.294 | 5.980 |
| 0.403 | 0.314 | 5.980 |
| 0.413 | 0.334 | 5.980 |
| 0.423 | 0.355 | 5.980 |
| 0.433 | 0.375 | 5.980 |
| 0.442 | 0.396 | 5.980 |
| 0.451 | 0.417 | 5.980 |
| 0.460 | 0.438 | 5.980 |
| 0.469 | 0.459 | 5.980 |
| 0.477 | 0.480 | 5.980 |
| 0.486 | 0.501 | 5.980 |
| 0.494 | 0.522 | 5.980 |
| 0.502 | 0.543 | 5.980 |
| 0.509 | 0.565 | 5.980 |
| 0.517 | 0.586 | 5.980 |
| 0.524 | 0.607 | 5.980 |
| 0.531 | 0.629 | 5.980 |
| 0.538 | 0.651 | 5.980 |
| 0.545 | 0.672 | 5.980 |
| 0.551 | 0.694 | 5.980 |
| 0.558 | 0.716 | 5.980 |
| 0.565 | 0.737 | 5.980 |
| 0.571 | 0.759 | 5.980 |
| 0.578 | 0.781 | 5.980 |
| 0.585 | 0.802 | 5.980 |
| 0.591 | 0.824 | 5.980 |
| 0.596 | 0.846 | 5.980 |
| 0.601 | 0.868 | 5.980 |
| 0.606 | 0.891 | 5.980 |

TABLE 2-continued

| X | Y | Z |
|---|---|---|
| 0.607 | 0.895 | 5.980 |
| 0.608 | 0.899 | 5.980 |
| 0.609 | 0.904 | 5.980 |
| 0.610 | 0.908 | 5.980 |
| 0.612 | 0.913 | 5.980 |
| 0.613 | 0.917 | 5.980 |
| 0.614 | 0.921 | 5.980 |
| 0.616 | 0.926 | 5.980 |
| 0.617 | 0.930 | 5.980 |
| 0.618 | 0.934 | 5.980 |
| 0.586 | 0.953 | 5.980 |
| 0.588 | 0.955 | 5.980 |
| 0.591 | 0.956 | 5.980 |
| 0.593 | 0.958 | 5.980 |
| 0.596 | 0.959 | 5.980 |
| 0.599 | 0.960 | 5.980 |
| 0.602 | 0.960 | 5.980 |
| 0.605 | 0.960 | 5.980 |
| 0.608 | 0.959 | 5.980 |
| 0.610 | 0.957 | 5.980 |
| 0.613 | 0.956 | 5.980 |
| 0.615 | 0.954 | 5.980 |
| 0.617 | 0.951 | 5.980 |
| 0.618 | 0.949 | 5.980 |
| 0.619 | 0.946 | 5.980 |
| 0.620 | 0.943 | 5.980 |
| 0.620 | 0.940 | 5.980 |
| 0.619 | 0.937 | 5.980 |
| −0.353 | −0.164 | 5.980 |
| −0.350 | −0.164 | 5.980 |
| −0.346 | −0.164 | 5.980 |
| −0.343 | −0.163 | 5.980 |
| −0.339 | −0.162 | 5.980 |
| −0.336 | −0.162 | 5.980 |
| −0.332 | −0.161 | 5.980 |
| −0.329 | −0.160 | 5.980 |
| −0.325 | −0.159 | 5.980 |
| −0.322 | −0.158 | 5.980 |
| −0.318 | −0.157 | 5.980 |
| −0.302 | −0.151 | 5.980 |
| −0.286 | −0.143 | 5.980 |
| −0.270 | −0.135 | 5.980 |
| −0.255 | −0.126 | 5.980 |
| −0.240 | −0.116 | 5.980 |
| −0.225 | −0.106 | 5.980 |
| −0.210 | −0.095 | 5.980 |
| −0.196 | −0.085 | 5.980 |
| −0.182 | −0.074 | 5.980 |
| −0.169 | −0.062 | 5.980 |
| −0.155 | −0.051 | 5.980 |
| −0.142 | −0.039 | 5.980 |
| −0.128 | −0.027 | 5.980 |
| −0.115 | −0.015 | 5.980 |
| −0.103 | −0.002 | 5.980 |
| −0.090 | 0.010 | 5.980 |
| −0.077 | 0.023 | 5.980 |
| −0.065 | 0.036 | 5.980 |
| −0.053 | 0.049 | 5.980 |
| −0.041 | 0.062 | 5.980 |
| −0.029 | 0.075 | 5.980 |
| −0.017 | 0.088 | 5.980 |
| −0.005 | 0.102 | 5.980 |
| 0.007 | 0.115 | 5.980 |
| 0.018 | 0.129 | 5.980 |
| 0.030 | 0.142 | 5.980 |
| 0.041 | 0.156 | 5.980 |
| 0.053 | 0.170 | 5.980 |
| 0.064 | 0.184 | 5.980 |
| 0.075 | 0.197 | 5.980 |
| 0.086 | 0.211 | 5.980 |
| 0.098 | 0.225 | 5.980 |
| 0.109 | 0.239 | 5.980 |
| 0.119 | 0.253 | 5.980 |
| 0.130 | 0.268 | 5.980 |
| 0.141 | 0.282 | 5.980 |
| 0.152 | 0.296 | 5.980 |
| 0.163 | 0.310 | 5.980 |
| 0.173 | 0.325 | 5.980 |

TABLE 2-continued

| X | Y | Z |
|---|---|---|
| 0.184 | 0.339 | 5.980 |
| 0.194 | 0.353 | 5.980 |
| 0.205 | 0.368 | 5.980 |
| 0.215 | 0.382 | 5.980 |
| 0.226 | 0.397 | 5.980 |
| 0.236 | 0.411 | 5.980 |
| 0.246 | 0.426 | 5.980 |
| 0.256 | 0.440 | 5.980 |
| 0.267 | 0.455 | 5.980 |
| 0.277 | 0.470 | 5.980 |
| 0.287 | 0.484 | 5.980 |
| 0.297 | 0.499 | 5.980 |
| 0.307 | 0.514 | 5.980 |
| 0.317 | 0.529 | 5.980 |
| 0.327 | 0.544 | 5.980 |
| 0.337 | 0.558 | 5.980 |
| 0.347 | 0.573 | 5.980 |
| 0.356 | 0.588 | 5.980 |
| 0.366 | 0.603 | 5.980 |
| 0.376 | 0.618 | 5.980 |
| 0.386 | 0.633 | 5.980 |
| 0.396 | 0.647 | 5.980 |
| 0.406 | 0.662 | 5.980 |
| 0.416 | 0.677 | 5.980 |
| 0.426 | 0.692 | 5.980 |
| 0.436 | 0.707 | 5.980 |
| 0.445 | 0.722 | 5.980 |
| 0.455 | 0.737 | 5.980 |
| 0.464 | 0.752 | 5.980 |
| 0.473 | 0.767 | 5.980 |
| 0.483 | 0.783 | 5.980 |
| 0.492 | 0.798 | 5.980 |
| 0.501 | 0.813 | 5.980 |
| 0.510 | 0.829 | 5.980 |
| 0.519 | 0.844 | 5.980 |
| 0.527 | 0.860 | 5.980 |
| 0.536 | 0.875 | 5.980 |
| 0.545 | 0.891 | 5.980 |
| 0.554 | 0.906 | 5.980 |
| 0.564 | 0.921 | 5.980 |
| 0.566 | 0.924 | 5.980 |
| 0.568 | 0.927 | 5.980 |
| 0.570 | 0.930 | 5.980 |
| 0.572 | 0.933 | 5.980 |
| 0.574 | 0.936 | 5.980 |
| 0.576 | 0.939 | 5.980 |
| 0.578 | 0.942 | 5.980 |
| 0.580 | 0.945 | 5.980 |
| 0.582 | 0.947 | 5.980 |
| 0.584 | 0.950 | 5.980 |
| −0.367 | −0.165 | 5.980 |
| −0.381 | −0.166 | 5.980 |
| −0.394 | −0.169 | 5.980 |
| −0.407 | −0.174 | 5.980 |
| −0.419 | −0.180 | 5.980 |
| −0.430 | −0.189 | 5.980 |
| −0.438 | −0.199 | 5.980 |
| −0.444 | −0.212 | 5.980 |
| −0.448 | −0.225 | 5.980 |
| −0.449 | −0.239 | 5.980 |
| −0.448 | −0.252 | 5.980 |
| −0.445 | −0.266 | 5.980 |
| −0.441 | −0.279 | 5.980 |
| −0.436 | −0.292 | 5.980 |
| −0.431 | −0.304 | 5.980 |
| −0.424 | −0.317 | 5.980 |
| −0.417 | −0.328 | 5.980 |
| −0.410 | −0.340 | 5.980 |
| | SECTION 2 | |
| −0.407 | −0.407 | 6.210 |
| −0.405 | −0.411 | 6.210 |
| −0.402 | −0.415 | 6.210 |
| −0.399 | −0.418 | 6.210 |
| −0.396 | −0.422 | 6.210 |
| −0.393 | −0.426 | 6.210 |
| −0.390 | −0.429 | 6.210 |
| −0.387 | −0.433 | 6.210 |

TABLE 2-continued

| X | Y | Z |
|---|---|---|
| −0.384 | −0.436 | 6.210 |
| −0.381 | −0.440 | 6.210 |
| −0.378 | −0.443 | 6.210 |
| −0.360 | −0.459 | 6.210 |
| −0.342 | −0.473 | 6.210 |
| −0.322 | −0.485 | 6.210 |
| −0.301 | −0.495 | 6.210 |
| −0.279 | −0.502 | 6.210 |
| −0.257 | −0.508 | 6.210 |
| −0.234 | −0.511 | 6.210 |
| −0.210 | −0.511 | 6.210 |
| −0.187 | −0.509 | 6.210 |
| −0.164 | −0.504 | 6.210 |
| −0.142 | −0.498 | 6.210 |
| −0.121 | −0.489 | 6.210 |
| −0.100 | −0.478 | 6.210 |
| −0.080 | −0.466 | 6.210 |
| −0.062 | −0.452 | 6.210 |
| −0.044 | −0.437 | 6.210 |
| −0.027 | −0.421 | 6.210 |
| −0.011 | −0.404 | 6.210 |
| 0.004 | −0.387 | 6.210 |
| 0.019 | −0.369 | 6.210 |
| 0.033 | −0.350 | 6.210 |
| 0.047 | −0.332 | 6.210 |
| 0.061 | −0.313 | 6.210 |
| 0.075 | −0.294 | 6.210 |
| 0.088 | −0.275 | 6.210 |
| 0.101 | −0.256 | 6.210 |
| 0.114 | −0.237 | 6.210 |
| 0.127 | −0.218 | 6.210 |
| 0.140 | −0.199 | 6.210 |
| 0.153 | −0.179 | 6.210 |
| 0.166 | −0.160 | 6.210 |
| 0.179 | −0.141 | 6.210 |
| 0.192 | −0.121 | 6.210 |
| 0.204 | −0.102 | 6.210 |
| 0.217 | −0.082 | 6.210 |
| 0.229 | −0.062 | 6.210 |
| 0.241 | −0.043 | 6.210 |
| 0.254 | −0.023 | 6.210 |
| 0.266 | −0.003 | 6.210 |
| 0.278 | 0.017 | 6.210 |
| 0.290 | 0.037 | 6.210 |
| 0.301 | 0.057 | 6.210 |
| 0.313 | 0.077 | 6.210 |
| 0.324 | 0.097 | 6.210 |
| 0.335 | 0.118 | 6.210 |
| 0.346 | 0.138 | 6.210 |
| 0.357 | 0.159 | 6.210 |
| 0.367 | 0.180 | 6.210 |
| 0.378 | 0.200 | 6.210 |
| 0.388 | 0.221 | 6.210 |
| 0.398 | 0.242 | 6.210 |
| 0.408 | 0.263 | 6.210 |
| 0.418 | 0.284 | 6.210 |
| 0.427 | 0.306 | 6.210 |
| 0.436 | 0.327 | 6.210 |
| 0.445 | 0.348 | 6.210 |
| 0.454 | 0.370 | 6.210 |
| 0.463 | 0.391 | 6.210 |
| 0.472 | 0.413 | 6.210 |
| 0.480 | 0.434 | 6.210 |
| 0.489 | 0.456 | 6.210 |
| 0.497 | 0.478 | 6.210 |
| 0.505 | 0.500 | 6.210 |
| 0.513 | 0.522 | 6.210 |
| 0.520 | 0.544 | 6.210 |
| 0.528 | 0.566 | 6.210 |
| 0.535 | 0.588 | 6.210 |
| 0.542 | 0.610 | 6.210 |
| 0.549 | 0.632 | 6.210 |
| 0.556 | 0.654 | 6.210 |
| 0.563 | 0.676 | 6.210 |
| 0.570 | 0.698 | 6.210 |
| 0.577 | 0.721 | 6.210 |
| 0.584 | 0.743 | 6.210 |
| 0.590 | 0.765 | 6.210 |

TABLE 2-continued

| X | Y | Z |
|---|---|---|
| 0.597 | 0.787 | 6.210 |
| 0.603 | 0.810 | 6.210 |
| 0.610 | 0.832 | 6.210 |
| 0.616 | 0.854 | 6.210 |
| 0.617 | 0.859 | 6.210 |
| 0.618 | 0.863 | 6.210 |
| 0.619 | 0.868 | 6.210 |
| 0.621 | 0.872 | 6.210 |
| 0.622 | 0.877 | 6.210 |
| 0.623 | 0.881 | 6.210 |
| 0.624 | 0.886 | 6.210 |
| 0.626 | 0.890 | 6.210 |
| 0.627 | 0.895 | 6.210 |
| 0.628 | 0.899 | 6.210 |
| 0.629 | 0.902 | 6.210 |
| 0.629 | 0.905 | 6.210 |
| 0.628 | 0.908 | 6.210 |
| 0.628 | 0.911 | 6.210 |
| 0.626 | 0.913 | 6.210 |
| 0.625 | 0.916 | 6.210 |
| 0.623 | 0.918 | 6.210 |
| 0.621 | 0.920 | 6.210 |
| 0.619 | 0.921 | 6.210 |
| 0.616 | 0.923 | 6.210 |
| 0.613 | 0.924 | 6.210 |
| 0.610 | 0.924 | 6.210 |
| 0.608 | 0.924 | 6.210 |
| 0.605 | 0.923 | 6.210 |
| 0.602 | 0.922 | 6.210 |
| 0.600 | 0.921 | 6.210 |
| 0.597 | 0.919 | 6.210 |
| 0.595 | 0.917 | 6.210 |
| 0.594 | 0.915 | 6.210 |
| 0.592 | 0.912 | 6.210 |
| 0.590 | 0.909 | 6.210 |
| 0.588 | 0.906 | 6.210 |
| 0.586 | 0.903 | 6.210 |
| 0.584 | 0.900 | 6.210 |
| 0.582 | 0.897 | 6.210 |
| 0.580 | 0.894 | 6.210 |
| 0.578 | 0.891 | 6.210 |
| 0.576 | 0.888 | 6.210 |
| 0.574 | 0.885 | 6.210 |
| 0.564 | 0.869 | 6.210 |
| 0.554 | 0.854 | 6.210 |
| 0.545 | 0.839 | 6.210 |
| 0.535 | 0.824 | 6.210 |
| 0.526 | 0.808 | 6.210 |
| 0.517 | 0.793 | 6.210 |
| 0.508 | 0.777 | 6.210 |
| 0.498 | 0.762 | 6.210 |
| 0.489 | 0.746 | 6.210 |
| 0.479 | 0.731 | 6.210 |
| 0.470 | 0.716 | 6.210 |
| 0.460 | 0.701 | 6.210 |
| 0.450 | 0.685 | 6.210 |
| 0.440 | 0.670 | 6.210 |
| 0.430 | 0.655 | 6.210 |
| 0.420 | 0.640 | 6.210 |
| 0.410 | 0.626 | 6.210 |
| 0.400 | 0.611 | 6.210 |
| 0.390 | 0.596 | 6.210 |
| 0.380 | 0.581 | 6.210 |
| 0.370 | 0.566 | 6.210 |
| 0.360 | 0.551 | 6.210 |
| 0.350 | 0.535 | 6.210 |
| 0.340 | 0.520 | 6.210 |
| 0.330 | 0.505 | 6.210 |
| 0.320 | 0.490 | 6.210 |
| 0.310 | 0.475 | 6.210 |
| 0.300 | 0.460 | 6.210 |
| 0.290 | 0.446 | 6.210 |
| 0.280 | 0.431 | 6.210 |
| 0.270 | 0.416 | 6.210 |
| 0.260 | 0.401 | 6.210 |
| 0.249 | 0.386 | 6.210 |
| 0.239 | 0.371 | 6.210 |
| 0.229 | 0.356 | 6.210 |

TABLE 2-continued

| X | Y | Z |
|---|---|---|
| 0.219 | 0.341 | 6.210 |
| 0.208 | 0.327 | 6.210 |
| 0.198 | 0.312 | 6.210 |
| 0.187 | 0.297 | 6.210 |
| 0.177 | 0.283 | 6.210 |
| 0.166 | 0.268 | 6.210 |
| 0.156 | 0.253 | 6.210 |
| 0.145 | 0.239 | 6.210 |
| 0.135 | 0.224 | 6.210 |
| 0.124 | 0.210 | 6.210 |
| 0.113 | 0.195 | 6.210 |
| 0.102 | 0.181 | 6.210 |
| 0.091 | 0.166 | 6.210 |
| 0.081 | 0.152 | 6.210 |
| 0.069 | 0.138 | 6.210 |
| 0.058 | 0.124 | 6.210 |
| 0.047 | 0.109 | 6.210 |
| 0.036 | 0.095 | 6.210 |
| 0.025 | 0.081 | 6.210 |
| 0.013 | 0.067 | 6.210 |
| 0.002 | 0.053 | 6.210 |
| −0.010 | 0.039 | 6.210 |
| −0.021 | 0.026 | 6.210 |
| −0.033 | 0.012 | 6.210 |
| −0.045 | −0.002 | 6.210 |
| −0.057 | −0.015 | 6.210 |
| −0.069 | −0.028 | 6.210 |
| −0.081 | −0.042 | 6.210 |
| −0.093 | −0.055 | 6.210 |
| −0.106 | −0.068 | 6.210 |
| −0.118 | −0.081 | 6.210 |
| −0.131 | −0.094 | 6.210 |
| −0.144 | −0.106 | 6.210 |
| −0.157 | −0.118 | 6.210 |
| −0.171 | −0.131 | 6.210 |
| −0.184 | −0.142 | 6.210 |
| −0.198 | −0.154 | 6.210 |
| −0.212 | −0.165 | 6.210 |
| −0.226 | −0.176 | 6.210 |
| −0.241 | −0.187 | 6.210 |
| −0.256 | −0.196 | 6.210 |
| −0.272 | −0.205 | 6.210 |
| −0.288 | −0.213 | 6.210 |
| −0.305 | −0.220 | 6.210 |
| −0.309 | −0.221 | 6.210 |
| −0.312 | −0.222 | 6.210 |
| −0.315 | −0.222 | 6.210 |
| −0.319 | −0.223 | 6.210 |
| −0.323 | −0.224 | 6.210 |
| −0.326 | −0.225 | 6.210 |
| −0.330 | −0.225 | 6.210 |
| −0.333 | −0.225 | 6.210 |
| −0.337 | −0.226 | 6.210 |
| −0.340 | −0.226 | 6.210 |
| −0.354 | −0.226 | 6.210 |
| −0.368 | −0.226 | 6.210 |
| −0.382 | −0.228 | 6.210 |
| −0.395 | −0.231 | 6.210 |
| −0.408 | −0.237 | 6.210 |
| −0.420 | −0.244 | 6.210 |
| −0.430 | −0.253 | 6.210 |
| −0.438 | −0.265 | 6.210 |
| −0.444 | −0.277 | 6.210 |
| −0.447 | −0.291 | 6.210 |
| −0.447 | −0.305 | 6.210 |
| −0.446 | −0.319 | 6.210 |
| −0.443 | −0.332 | 6.210 |
| −0.439 | −0.346 | 6.210 |
| −0.434 | −0.359 | 6.210 |
| −0.428 | −0.371 | 6.210 |
| −0.422 | −0.384 | 6.210 |
| −0.415 | −0.396 | 6.210 |
| SECTION 3 | | |
| −0.411 | −0.458 | 6.440 |
| −0.408 | −0.462 | 6.440 |
| −0.406 | −0.466 | 6.440 |
| −0.403 | −0.469 | 6.440 |

TABLE 2-continued

| X | Y | Z |
|---|---|---|
| −0.400 | −0.473 | 6.440 |
| −0.397 | −0.477 | 6.440 |
| −0.394 | −0.481 | 6.440 |
| −0.391 | −0.484 | 6.440 |
| −0.388 | −0.488 | 6.440 |
| −0.385 | −0.492 | 6.440 |
| −0.382 | −0.495 | 6.440 |
| −0.364 | −0.511 | 6.440 |
| −0.346 | −0.526 | 6.440 |
| −0.326 | −0.539 | 6.440 |
| −0.305 | −0.549 | 6.440 |
| −0.282 | −0.558 | 6.440 |
| −0.259 | −0.564 | 6.440 |
| −0.236 | −0.567 | 6.440 |
| −0.212 | −0.568 | 6.440 |
| −0.189 | −0.567 | 6.440 |
| −0.165 | −0.563 | 6.440 |
| −0.142 | −0.557 | 6.440 |
| −0.120 | −0.549 | 6.440 |
| −0.098 | −0.539 | 6.440 |
| −0.078 | −0.528 | 6.440 |
| −0.058 | −0.515 | 6.440 |
| −0.039 | −0.500 | 6.440 |
| −0.021 | −0.485 | 6.440 |
| −0.004 | −0.468 | 6.440 |
| 0.013 | −0.451 | 6.440 |
| 0.028 | −0.434 | 6.440 |
| 0.044 | −0.416 | 6.440 |
| 0.059 | −0.397 | 6.440 |
| 0.074 | −0.379 | 6.440 |
| 0.088 | −0.360 | 6.440 |
| 0.102 | −0.341 | 6.440 |
| 0.116 | −0.321 | 6.440 |
| 0.129 | −0.302 | 6.440 |
| 0.142 | −0.282 | 6.440 |
| 0.155 | −0.262 | 6.440 |
| 0.168 | −0.242 | 6.440 |
| 0.181 | −0.222 | 6.440 |
| 0.194 | −0.202 | 6.440 |
| 0.206 | −0.182 | 6.440 |
| 0.219 | −0.162 | 6.440 |
| 0.231 | −0.142 | 6.440 |
| 0.243 | −0.121 | 6.440 |
| 0.255 | −0.101 | 6.440 |
| 0.267 | −0.080 | 6.440 |
| 0.278 | −0.059 | 6.440 |
| 0.290 | −0.039 | 6.440 |
| 0.301 | −0.018 | 6.440 |
| 0.313 | 0.003 | 6.440 |
| 0.324 | 0.024 | 6.440 |
| 0.334 | 0.045 | 6.440 |
| 0.345 | 0.066 | 6.440 |
| 0.356 | 0.088 | 6.440 |
| 0.366 | 0.109 | 6.440 |
| 0.376 | 0.130 | 6.440 |
| 0.386 | 0.152 | 6.440 |
| 0.396 | 0.174 | 6.440 |
| 0.406 | 0.195 | 6.440 |
| 0.415 | 0.217 | 6.440 |
| 0.424 | 0.239 | 6.440 |
| 0.434 | 0.261 | 6.440 |
| 0.443 | 0.283 | 6.440 |
| 0.452 | 0.305 | 6.440 |
| 0.460 | 0.327 | 6.440 |
| 0.469 | 0.349 | 6.440 |
| 0.477 | 0.371 | 6.440 |
| 0.486 | 0.393 | 6.440 |
| 0.494 | 0.415 | 6.440 |
| 0.502 | 0.438 | 6.440 |
| 0.510 | 0.460 | 6.440 |
| 0.518 | 0.482 | 6.440 |
| 0.526 | 0.505 | 6.440 |
| 0.533 | 0.527 | 6.440 |
| 0.540 | 0.550 | 6.440 |
| 0.548 | 0.572 | 6.440 |
| 0.555 | 0.595 | 6.440 |
| 0.562 | 0.618 | 6.440 |
| 0.569 | 0.640 | 6.440 |

TABLE 2-continued

| X | Y | Z |
|---|---|---|
| 0.576 | 0.663 | 6.440 |
| 0.583 | 0.686 | 6.440 |
| 0.590 | 0.708 | 6.440 |
| 0.597 | 0.731 | 6.440 |
| 0.604 | 0.754 | 6.440 |
| 0.611 | 0.776 | 6.440 |
| 0.618 | 0.799 | 6.440 |
| 0.625 | 0.822 | 6.440 |
| 0.626 | 0.826 | 6.440 |
| 0.627 | 0.831 | 6.440 |
| 0.629 | 0.835 | 6.440 |
| 0.630 | 0.840 | 6.440 |
| 0.631 | 0.845 | 6.440 |
| 0.633 | 0.849 | 6.440 |
| 0.634 | 0.854 | 6.440 |
| 0.635 | 0.858 | 6.440 |
| 0.636 | 0.863 | 6.440 |
| 0.638 | 0.867 | 6.440 |
| 0.638 | 0.870 | 6.440 |
| 0.638 | 0.873 | 6.440 |
| 0.638 | 0.876 | 6.440 |
| 0.637 | 0.879 | 6.440 |
| 0.636 | 0.881 | 6.440 |
| 0.635 | 0.884 | 6.440 |
| 0.633 | 0.886 | 6.440 |
| 0.631 | 0.888 | 6.440 |
| 0.628 | 0.890 | 6.440 |
| 0.626 | 0.891 | 6.440 |
| 0.623 | 0.892 | 6.440 |
| 0.620 | 0.892 | 6.440 |
| 0.617 | 0.892 | 6.440 |
| 0.615 | 0.892 | 6.440 |
| 0.612 | 0.890 | 6.440 |
| 0.609 | 0.889 | 6.440 |
| 0.607 | 0.887 | 6.440 |
| 0.605 | 0.885 | 6.440 |
| 0.603 | 0.883 | 6.440 |
| 0.601 | 0.880 | 6.440 |
| 0.599 | 0.877 | 6.440 |
| 0.597 | 0.874 | 6.440 |
| 0.595 | 0.871 | 6.440 |
| 0.593 | 0.868 | 6.440 |
| 0.591 | 0.865 | 6.440 |
| 0.589 | 0.862 | 6.440 |
| 0.587 | 0.859 | 6.440 |
| 0.585 | 0.856 | 6.440 |
| 0.583 | 0.853 | 6.440 |
| 0.573 | 0.838 | 6.440 |
| 0.563 | 0.822 | 6.440 |
| 0.553 | 0.807 | 6.440 |
| 0.544 | 0.791 | 6.440 |
| 0.534 | 0.776 | 6.440 |
| 0.525 | 0.760 | 6.440 |
| 0.515 | 0.745 | 6.440 |
| 0.505 | 0.729 | 6.440 |
| 0.496 | 0.714 | 6.440 |
| 0.486 | 0.698 | 6.440 |
| 0.476 | 0.683 | 6.440 |
| 0.466 | 0.668 | 6.440 |
| 0.456 | 0.652 | 6.440 |
| 0.446 | 0.637 | 6.440 |
| 0.436 | 0.622 | 6.440 |
| 0.426 | 0.607 | 6.440 |
| 0.416 | 0.592 | 6.440 |
| 0.406 | 0.577 | 6.440 |
| 0.395 | 0.562 | 6.440 |
| 0.385 | 0.546 | 6.440 |
| 0.375 | 0.531 | 6.440 |
| 0.365 | 0.516 | 6.440 |
| 0.355 | 0.501 | 6.440 |
| 0.345 | 0.485 | 6.440 |
| 0.335 | 0.470 | 6.440 |
| 0.325 | 0.455 | 6.440 |
| 0.315 | 0.440 | 6.440 |
| 0.305 | 0.425 | 6.440 |
| 0.295 | 0.409 | 6.440 |
| 0.285 | 0.394 | 6.440 |
| 0.275 | 0.379 | 6.440 |

TABLE 2-continued

| X | Y | Z |
|---|---|---|
| 0.265 | 0.364 | 6.440 |
| 0.254 | 0.349 | 6.440 |
| 0.244 | 0.334 | 6.440 |
| 0.234 | 0.319 | 6.440 |
| 0.224 | 0.304 | 6.440 |
| 0.213 | 0.289 | 6.440 |
| 0.203 | 0.274 | 6.440 |
| 0.193 | 0.259 | 6.440 |
| 0.182 | 0.244 | 6.440 |
| 0.172 | 0.229 | 6.440 |
| 0.161 | 0.214 | 6.440 |
| 0.151 | 0.199 | 6.440 |
| 0.140 | 0.184 | 6.440 |
| 0.130 | 0.169 | 6.440 |
| 0.119 | 0.154 | 6.440 |
| 0.108 | 0.140 | 6.440 |
| 0.098 | 0.125 | 6.440 |
| 0.087 | 0.110 | 6.440 |
| 0.076 | 0.096 | 6.440 |
| 0.065 | 0.081 | 6.440 |
| 0.054 | 0.067 | 6.440 |
| 0.043 | 0.052 | 6.440 |
| 0.032 | 0.038 | 6.440 |
| 0.020 | 0.023 | 6.440 |
| 0.009 | 0.009 | 6.440 |
| −0.002 | −0.005 | 6.440 |
| −0.014 | −0.019 | 6.440 |
| −0.025 | −0.033 | 6.440 |
| −0.037 | −0.047 | 6.440 |
| −0.049 | −0.061 | 6.440 |
| −0.061 | −0.075 | 6.440 |
| −0.073 | −0.089 | 6.440 |
| −0.085 | −0.103 | 6.440 |
| −0.097 | −0.116 | 6.440 |
| −0.109 | −0.129 | 6.440 |
| −0.122 | −0.143 | 6.440 |
| −0.135 | −0.156 | 6.440 |
| −0.148 | −0.168 | 6.440 |
| −0.161 | −0.181 | 6.440 |
| −0.174 | −0.193 | 6.440 |
| −0.188 | −0.205 | 6.440 |
| −0.202 | −0.217 | 6.440 |
| −0.216 | −0.229 | 6.440 |
| −0.231 | −0.240 | 6.440 |
| −0.246 | −0.250 | 6.440 |
| −0.262 | −0.259 | 6.440 |
| −0.278 | −0.267 | 6.440 |
| −0.295 | −0.273 | 6.440 |
| −0.299 | −0.274 | 6.440 |
| −0.302 | −0.275 | 6.440 |
| −0.306 | −0.276 | 6.440 |
| −0.309 | −0.277 | 6.440 |
| −0.313 | −0.278 | 6.440 |
| −0.316 | −0.278 | 6.440 |
| −0.320 | −0.279 | 6.440 |
| −0.324 | −0.279 | 6.440 |
| −0.327 | −0.279 | 6.440 |
| −0.331 | −0.279 | 6.440 |
| −0.345 | −0.279 | 6.440 |
| −0.359 | −0.279 | 6.440 |
| −0.373 | −0.280 | 6.440 |
| −0.387 | −0.283 | 6.440 |
| −0.400 | −0.287 | 6.440 |
| −0.413 | −0.294 | 6.440 |
| −0.424 | −0.302 | 6.440 |
| −0.434 | −0.313 | 6.440 |
| −0.441 | −0.325 | 6.440 |
| −0.445 | −0.338 | 6.440 |
| −0.447 | −0.352 | 6.440 |
| −0.446 | −0.366 | 6.440 |
| −0.444 | −0.380 | 6.440 |
| −0.441 | −0.394 | 6.440 |
| −0.437 | −0.408 | 6.440 |
| −0.431 | −0.421 | 6.440 |

TABLE 2-continued

| X | Y | Z |
|---|---|---|
| −0.425 | −0.433 | 6.440 |
| −0.418 | −0.446 | 6.440 |
| SECTION 4 | | |
| −0.414 | −0.504 | 6.670 |
| −0.411 | −0.508 | 6.670 |
| −0.409 | −0.512 | 6.670 |
| −0.406 | −0.516 | 6.670 |
| −0.403 | −0.520 | 6.670 |
| −0.400 | −0.524 | 6.670 |
| −0.397 | −0.528 | 6.670 |
| −0.394 | −0.532 | 6.670 |
| −0.391 | −0.535 | 6.670 |
| −0.388 | −0.539 | 6.670 |
| −0.385 | −0.542 | 6.670 |
| −0.367 | −0.559 | 6.670 |
| −0.348 | −0.575 | 6.670 |
| −0.328 | −0.588 | 6.670 |
| −0.307 | −0.599 | 6.670 |
| −0.284 | −0.607 | 6.670 |
| −0.261 | −0.614 | 6.670 |
| −0.237 | −0.618 | 6.670 |
| −0.213 | −0.619 | 6.670 |
| −0.189 | −0.618 | 6.670 |
| −0.165 | −0.615 | 6.670 |
| −0.141 | −0.610 | 6.670 |
| −0.118 | −0.603 | 6.670 |
| −0.096 | −0.593 | 6.670 |
| −0.074 | −0.582 | 6.670 |
| −0.053 | −0.570 | 6.670 |
| −0.033 | −0.556 | 6.670 |
| −0.014 | −0.542 | 6.670 |
| 0.004 | −0.526 | 6.670 |
| 0.022 | −0.509 | 6.670 |
| 0.039 | −0.492 | 6.670 |
| 0.055 | −0.474 | 6.670 |
| 0.071 | −0.456 | 6.670 |
| 0.086 | −0.437 | 6.670 |
| 0.101 | −0.418 | 6.670 |
| 0.116 | −0.399 | 6.670 |
| 0.130 | −0.380 | 6.670 |
| 0.144 | −0.360 | 6.670 |
| 0.158 | −0.340 | 6.670 |
| 0.171 | −0.320 | 6.670 |
| 0.184 | −0.299 | 6.670 |
| 0.197 | −0.279 | 6.670 |
| 0.210 | −0.258 | 6.670 |
| 0.222 | −0.237 | 6.670 |
| 0.234 | −0.216 | 6.670 |
| 0.246 | −0.195 | 6.670 |
| 0.258 | −0.174 | 6.670 |
| 0.270 | −0.153 | 6.670 |
| 0.281 | −0.132 | 6.670 |
| 0.292 | −0.110 | 6.670 |
| 0.303 | −0.089 | 6.670 |
| 0.314 | −0.067 | 6.670 |
| 0.325 | −0.046 | 6.670 |
| 0.336 | −0.024 | 6.670 |
| 0.346 | −0.002 | 6.670 |
| 0.356 | 0.020 | 6.670 |
| 0.367 | 0.042 | 6.670 |
| 0.376 | 0.064 | 6.670 |
| 0.386 | 0.086 | 6.670 |
| 0.396 | 0.108 | 6.670 |
| 0.405 | 0.130 | 6.670 |
| 0.415 | 0.153 | 6.670 |
| 0.424 | 0.175 | 6.670 |
| 0.433 | 0.198 | 6.670 |
| 0.442 | 0.220 | 6.670 |
| 0.451 | 0.243 | 6.670 |
| 0.459 | 0.265 | 6.670 |
| 0.468 | 0.288 | 6.670 |
| 0.476 | 0.310 | 6.670 |
| 0.485 | 0.333 | 6.670 |
| 0.493 | 0.356 | 6.670 |
| 0.501 | 0.379 | 6.670 |
| 0.509 | 0.401 | 6.670 |
| 0.517 | 0.424 | 6.670 |

TABLE 2-continued

| X | Y | Z |
|---|---|---|
| 0.525 | 0.447 | 6.670 |
| 0.533 | 0.470 | 6.670 |
| 0.540 | 0.493 | 6.670 |
| 0.548 | 0.516 | 6.670 |
| 0.555 | 0.539 | 6.670 |
| 0.562 | 0.562 | 6.670 |
| 0.569 | 0.585 | 6.670 |
| 0.577 | 0.608 | 6.670 |
| 0.584 | 0.631 | 6.670 |
| 0.591 | 0.655 | 6.670 |
| 0.598 | 0.678 | 6.670 |
| 0.606 | 0.701 | 6.670 |
| 0.613 | 0.724 | 6.670 |
| 0.620 | 0.747 | 6.670 |
| 0.627 | 0.770 | 6.670 |
| 0.634 | 0.793 | 6.670 |
| 0.635 | 0.798 | 6.670 |
| 0.637 | 0.802 | 6.670 |
| 0.638 | 0.807 | 6.670 |
| 0.639 | 0.812 | 6.670 |
| 0.641 | 0.816 | 6.670 |
| 0.642 | 0.821 | 6.670 |
| 0.644 | 0.826 | 6.670 |
| 0.645 | 0.830 | 6.670 |
| 0.646 | 0.835 | 6.670 |
| 0.648 | 0.840 | 6.670 |
| 0.648 | 0.842 | 6.670 |
| 0.648 | 0.845 | 6.670 |
| 0.648 | 0.848 | 6.670 |
| 0.647 | 0.851 | 6.670 |
| 0.646 | 0.854 | 6.670 |
| 0.645 | 0.856 | 6.670 |
| 0.643 | 0.858 | 6.670 |
| 0.641 | 0.860 | 6.670 |
| 0.639 | 0.862 | 6.670 |
| 0.636 | 0.863 | 6.670 |
| 0.633 | 0.864 | 6.670 |
| 0.630 | 0.865 | 6.670 |
| 0.627 | 0.864 | 6.670 |
| 0.625 | 0.864 | 6.670 |
| 0.622 | 0.863 | 6.670 |
| 0.619 | 0.861 | 6.670 |
| 0.617 | 0.860 | 6.670 |
| 0.615 | 0.858 | 6.670 |
| 0.613 | 0.855 | 6.670 |
| 0.611 | 0.852 | 6.670 |
| 0.609 | 0.849 | 6.670 |
| 0.607 | 0.846 | 6.670 |
| 0.605 | 0.843 | 6.670 |
| 0.603 | 0.840 | 6.670 |
| 0.601 | 0.837 | 6.670 |
| 0.599 | 0.834 | 6.670 |
| 0.597 | 0.831 | 6.670 |
| 0.595 | 0.828 | 6.670 |
| 0.593 | 0.825 | 6.670 |
| 0.582 | 0.810 | 6.670 |
| 0.572 | 0.794 | 6.670 |
| 0.562 | 0.779 | 6.670 |
| 0.552 | 0.763 | 6.670 |
| 0.543 | 0.747 | 6.670 |
| 0.533 | 0.732 | 6.670 |
| 0.523 | 0.716 | 6.670 |
| 0.513 | 0.700 | 6.670 |
| 0.504 | 0.685 | 6.670 |
| 0.494 | 0.669 | 6.670 |
| 0.484 | 0.654 | 6.670 |
| 0.474 | 0.638 | 6.670 |
| 0.464 | 0.623 | 6.670 |
| 0.454 | 0.607 | 6.670 |
| 0.443 | 0.592 | 6.670 |
| 0.433 | 0.577 | 6.670 |
| 0.423 | 0.561 | 6.670 |
| 0.413 | 0.546 | 6.670 |
| 0.402 | 0.531 | 6.670 |
| 0.392 | 0.515 | 6.670 |
| 0.382 | 0.500 | 6.670 |
| 0.372 | 0.484 | 6.670 |
| 0.362 | 0.469 | 6.670 |

TABLE 2-continued

| X | Y | Z |
|---|---|---|
| 0.352 | 0.454 | 6.670 |
| 0.342 | 0.438 | 6.670 |
| 0.332 | 0.423 | 6.670 |
| 0.322 | 0.407 | 6.670 |
| 0.312 | 0.392 | 6.670 |
| 0.302 | 0.376 | 6.670 |
| 0.291 | 0.361 | 6.670 |
| 0.281 | 0.346 | 6.670 |
| 0.271 | 0.330 | 6.670 |
| 0.261 | 0.315 | 6.670 |
| 0.251 | 0.300 | 6.670 |
| 0.240 | 0.284 | 6.670 |
| 0.230 | 0.269 | 6.670 |
| 0.220 | 0.254 | 6.670 |
| 0.209 | 0.238 | 6.670 |
| 0.199 | 0.223 | 6.670 |
| 0.189 | 0.208 | 6.670 |
| 0.178 | 0.193 | 6.670 |
| 0.168 | 0.177 | 6.670 |
| 0.157 | 0.162 | 6.670 |
| 0.147 | 0.147 | 6.670 |
| 0.136 | 0.132 | 6.670 |
| 0.126 | 0.117 | 6.670 |
| 0.115 | 0.102 | 6.670 |
| 0.104 | 0.087 | 6.670 |
| 0.094 | 0.072 | 6.670 |
| 0.083 | 0.057 | 6.670 |
| 0.072 | 0.042 | 6.670 |
| 0.061 | 0.027 | 6.670 |
| 0.050 | 0.012 | 6.670 |
| 0.039 | −0.002 | 6.670 |
| 0.028 | −0.017 | 6.670 |
| 0.017 | −0.032 | 6.670 |
| 0.005 | −0.046 | 6.670 |
| −0.006 | −0.061 | 6.670 |
| −0.017 | −0.075 | 6.670 |
| −0.029 | −0.090 | 6.670 |
| −0.041 | −0.104 | 6.670 |
| −0.052 | −0.118 | 6.670 |
| −0.064 | −0.132 | 6.670 |
| −0.076 | −0.146 | 6.670 |
| −0.088 | −0.160 | 6.670 |
| −0.101 | −0.174 | 6.670 |
| −0.113 | −0.187 | 6.670 |
| −0.126 | −0.201 | 6.670 |
| −0.139 | −0.214 | 6.670 |
| −0.152 | −0.227 | 6.670 |
| −0.165 | −0.240 | 6.670 |
| −0.179 | −0.252 | 6.670 |
| −0.193 | −0.264 | 6.670 |
| −0.207 | −0.276 | 6.670 |
| −0.221 | −0.287 | 6.670 |
| −0.237 | −0.298 | 6.670 |
| −0.252 | −0.307 | 6.670 |
| −0.269 | −0.315 | 6.670 |
| −0.286 | −0.322 | 6.670 |
| −0.290 | −0.323 | 6.670 |
| −0.293 | −0.324 | 6.670 |
| −0.297 | −0.325 | 6.670 |
| −0.300 | −0.325 | 6.670 |
| −0.304 | −0.326 | 6.670 |
| −0.308 | −0.327 | 6.670 |
| −0.311 | −0.327 | 6.670 |
| −0.315 | −0.327 | 6.670 |
| −0.319 | −0.327 | 6.670 |
| −0.322 | −0.327 | 6.670 |
| −0.337 | −0.327 | 6.670 |
| −0.351 | −0.327 | 6.670 |
| −0.365 | −0.328 | 6.670 |
| −0.379 | −0.330 | 6.670 |
| −0.393 | −0.334 | 6.670 |
| −0.406 | −0.340 | 6.670 |
| −0.418 | −0.348 | 6.670 |
| −0.429 | −0.357 | 6.670 |
| −0.437 | −0.369 | 6.670 |
| −0.442 | −0.382 | 6.670 |
| −0.445 | −0.396 | 6.670 |
| −0.446 | −0.410 | 6.670 |

TABLE 2-continued

| X | Y | Z |
|---|---|---|
| −0.445 | −0.425 | 6.670 |
| −0.443 | −0.439 | 6.670 |
| −0.439 | −0.452 | 6.670 |
| −0.433 | −0.466 | 6.670 |
| −0.428 | −0.479 | 6.670 |
| −0.421 | −0.492 | 6.670 |
| | SECTION 5 | |
| −0.416 | −0.546 | 6.900 |
| −0.414 | −0.551 | 6.900 |
| −0.411 | −0.555 | 6.900 |
| −0.408 | −0.559 | 6.900 |
| −0.406 | −0.563 | 6.900 |
| −0.403 | −0.567 | 6.900 |
| −0.400 | −0.571 | 6.900 |
| −0.397 | −0.575 | 6.900 |
| −0.393 | −0.578 | 6.900 |
| −0.390 | −0.582 | 6.900 |
| −0.387 | −0.586 | 6.900 |
| −0.369 | −0.603 | 6.900 |
| −0.350 | −0.618 | 6.900 |
| −0.329 | −0.632 | 6.900 |
| −0.307 | −0.643 | 6.900 |
| −0.284 | −0.652 | 6.900 |
| −0.261 | −0.658 | 6.900 |
| −0.236 | −0.662 | 6.900 |
| −0.212 | −0.664 | 6.900 |
| −0.187 | −0.664 | 6.900 |
| −0.163 | −0.661 | 6.900 |
| −0.139 | −0.656 | 6.900 |
| −0.115 | −0.650 | 6.900 |
| −0.092 | −0.641 | 6.900 |
| −0.069 | −0.631 | 6.900 |
| −0.048 | −0.619 | 6.900 |
| −0.027 | −0.606 | 6.900 |
| −0.007 | −0.592 | 6.900 |
| 0.013 | −0.577 | 6.900 |
| 0.031 | −0.561 | 6.900 |
| 0.049 | −0.544 | 6.900 |
| 0.067 | −0.527 | 6.900 |
| 0.083 | −0.508 | 6.900 |
| 0.100 | −0.490 | 6.900 |
| 0.115 | −0.471 | 6.900 |
| 0.131 | −0.452 | 6.900 |
| 0.145 | −0.432 | 6.900 |
| 0.160 | −0.412 | 6.900 |
| 0.174 | −0.391 | 6.900 |
| 0.187 | −0.371 | 6.900 |
| 0.200 | −0.350 | 6.900 |
| 0.213 | −0.329 | 6.900 |
| 0.226 | −0.308 | 6.900 |
| 0.238 | −0.287 | 6.900 |
| 0.250 | −0.265 | 6.900 |
| 0.262 | −0.243 | 6.900 |
| 0.273 | −0.222 | 6.900 |
| 0.285 | −0.200 | 6.900 |
| 0.296 | −0.178 | 6.900 |
| 0.307 | −0.156 | 6.900 |
| 0.318 | −0.134 | 6.900 |
| 0.328 | −0.112 | 6.900 |
| 0.339 | −0.089 | 6.900 |
| 0.349 | −0.067 | 6.900 |
| 0.359 | −0.044 | 6.900 |
| 0.369 | −0.022 | 6.900 |
| 0.379 | 0.001 | 6.900 |
| 0.388 | 0.024 | 6.900 |
| 0.398 | 0.046 | 6.900 |
| 0.407 | 0.069 | 6.900 |
| 0.416 | 0.092 | 6.900 |
| 0.425 | 0.115 | 6.900 |
| 0.434 | 0.138 | 6.900 |
| 0.443 | 0.161 | 6.900 |
| 0.452 | 0.184 | 6.900 |
| 0.460 | 0.207 | 6.900 |
| 0.469 | 0.230 | 6.900 |
| 0.477 | 0.253 | 6.900 |
| 0.485 | 0.276 | 6.900 |
| 0.494 | 0.300 | 6.900 |

TABLE 2-continued

| X | Y | Z |
|---|---|---|
| 0.502 | 0.323 | 6.900 |
| 0.510 | 0.346 | 6.900 |
| 0.518 | 0.370 | 6.900 |
| 0.526 | 0.393 | 6.900 |
| 0.533 | 0.416 | 6.900 |
| 0.541 | 0.440 | 6.900 |
| 0.549 | 0.463 | 6.900 |
| 0.556 | 0.487 | 6.900 |
| 0.563 | 0.510 | 6.900 |
| 0.571 | 0.534 | 6.900 |
| 0.578 | 0.557 | 6.900 |
| 0.586 | 0.581 | 6.900 |
| 0.593 | 0.604 | 6.900 |
| 0.600 | 0.628 | 6.900 |
| 0.608 | 0.651 | 6.900 |
| 0.615 | 0.675 | 6.900 |
| 0.622 | 0.698 | 6.900 |
| 0.629 | 0.722 | 6.900 |
| 0.637 | 0.745 | 6.900 |
| 0.644 | 0.769 | 6.900 |
| 0.645 | 0.774 | 6.900 |
| 0.647 | 0.778 | 6.900 |
| 0.648 | 0.783 | 6.900 |
| 0.649 | 0.788 | 6.900 |
| 0.651 | 0.792 | 6.900 |
| 0.652 | 0.797 | 6.900 |
| 0.654 | 0.802 | 6.900 |
| 0.655 | 0.807 | 6.900 |
| 0.656 | 0.811 | 6.900 |
| 0.658 | 0.816 | 6.900 |
| 0.658 | 0.819 | 6.900 |
| 0.658 | 0.822 | 6.900 |
| 0.658 | 0.825 | 6.900 |
| 0.657 | 0.827 | 6.900 |
| 0.656 | 0.830 | 6.900 |
| 0.655 | 0.833 | 6.900 |
| 0.653 | 0.835 | 6.900 |
| 0.651 | 0.837 | 6.900 |
| 0.649 | 0.838 | 6.900 |
| 0.646 | 0.840 | 6.900 |
| 0.643 | 0.841 | 6.900 |
| 0.640 | 0.841 | 6.900 |
| 0.638 | 0.841 | 6.900 |
| 0.635 | 0.840 | 6.900 |
| 0.632 | 0.839 | 6.900 |
| 0.630 | 0.838 | 6.900 |
| 0.627 | 0.836 | 6.900 |
| 0.625 | 0.834 | 6.900 |
| 0.623 | 0.832 | 6.900 |
| 0.621 | 0.829 | 6.900 |
| 0.619 | 0.825 | 6.900 |
| 0.617 | 0.822 | 6.900 |
| 0.615 | 0.819 | 6.900 |
| 0.613 | 0.816 | 6.900 |
| 0.611 | 0.813 | 6.900 |
| 0.609 | 0.810 | 6.900 |
| 0.607 | 0.807 | 6.900 |
| 0.605 | 0.804 | 6.900 |
| 0.603 | 0.801 | 6.900 |
| 0.592 | 0.785 | 6.900 |
| 0.582 | 0.770 | 6.900 |
| 0.572 | 0.754 | 6.900 |
| 0.562 | 0.738 | 6.900 |
| 0.552 | 0.722 | 6.900 |
| 0.542 | 0.707 | 6.900 |
| 0.532 | 0.691 | 6.900 |
| 0.522 | 0.675 | 6.900 |
| 0.512 | 0.659 | 6.900 |
| 0.502 | 0.643 | 6.900 |
| 0.492 | 0.628 | 6.900 |
| 0.482 | 0.612 | 6.900 |
| 0.472 | 0.596 | 6.900 |
| 0.462 | 0.581 | 6.900 |
| 0.452 | 0.565 | 6.900 |
| 0.441 | 0.550 | 6.900 |
| 0.431 | 0.534 | 6.900 |
| 0.421 | 0.519 | 6.900 |
| 0.410 | 0.503 | 6.900 |

TABLE 2-continued

| X | Y | Z |
|---|---|---|
| 0.400 | 0.487 | 6.900 |
| 0.390 | 0.472 | 6.900 |
| 0.380 | 0.456 | 6.900 |
| 0.370 | 0.441 | 6.900 |
| 0.360 | 0.425 | 6.900 |
| 0.350 | 0.409 | 6.900 |
| 0.339 | 0.394 | 6.900 |
| 0.329 | 0.378 | 6.900 |
| 0.319 | 0.362 | 6.900 |
| 0.309 | 0.347 | 6.900 |
| 0.299 | 0.331 | 6.900 |
| 0.289 | 0.315 | 6.900 |
| 0.278 | 0.300 | 6.900 |
| 0.268 | 0.284 | 6.900 |
| 0.258 | 0.269 | 6.900 |
| 0.248 | 0.253 | 6.900 |
| 0.237 | 0.238 | 6.900 |
| 0.227 | 0.222 | 6.900 |
| 0.217 | 0.206 | 6.900 |
| 0.206 | 0.191 | 6.900 |
| 0.196 | 0.175 | 6.900 |
| 0.185 | 0.160 | 6.900 |
| 0.175 | 0.145 | 6.900 |
| 0.165 | 0.129 | 6.900 |
| 0.154 | 0.114 | 6.900 |
| 0.144 | 0.098 | 6.900 |
| 0.133 | 0.083 | 6.900 |
| 0.122 | 0.068 | 6.900 |
| 0.112 | 0.052 | 6.900 |
| 0.101 | 0.037 | 6.900 |
| 0.090 | 0.022 | 6.900 |
| 0.079 | 0.007 | 6.900 |
| 0.069 | −0.009 | 6.900 |
| 0.058 | −0.024 | 6.900 |
| 0.047 | −0.039 | 6.900 |
| 0.036 | −0.054 | 6.900 |
| 0.024 | −0.069 | 6.900 |
| 0.013 | −0.084 | 6.900 |
| 0.002 | −0.098 | 6.900 |
| −0.010 | −0.113 | 6.900 |
| −0.021 | −0.128 | 6.900 |
| −0.033 | −0.142 | 6.900 |
| −0.044 | −0.157 | 6.900 |
| −0.056 | −0.171 | 6.900 |
| −0.068 | −0.186 | 6.900 |
| −0.080 | −0.200 | 6.900 |
| −0.092 | −0.214 | 6.900 |
| −0.105 | −0.228 | 6.900 |
| −0.117 | −0.242 | 6.900 |
| −0.130 | −0.255 | 6.900 |
| −0.143 | −0.269 | 6.900 |
| −0.156 | −0.282 | 6.900 |
| −0.170 | −0.295 | 6.900 |
| −0.184 | −0.307 | 6.900 |
| −0.198 | −0.319 | 6.900 |
| −0.212 | −0.331 | 6.900 |
| −0.228 | −0.342 | 6.900 |
| −0.244 | −0.351 | 6.900 |
| −0.260 | −0.360 | 6.900 |
| −0.278 | −0.366 | 6.900 |
| −0.281 | −0.367 | 6.900 |
| −0.285 | −0.368 | 6.900 |
| −0.289 | −0.369 | 6.900 |
| −0.292 | −0.370 | 6.900 |
| −0.296 | −0.370 | 6.900 |
| −0.300 | −0.371 | 6.900 |
| −0.303 | −0.371 | 6.900 |
| −0.307 | −0.371 | 6.900 |
| −0.311 | −0.371 | 6.900 |
| −0.315 | −0.371 | 6.900 |
| −0.329 | −0.371 | 6.900 |
| −0.343 | −0.371 | 6.900 |
| −0.358 | −0.372 | 6.900 |
| −0.372 | −0.374 | 6.900 |
| −0.386 | −0.378 | 6.900 |
| −0.400 | −0.383 | 6.900 |
| −0.412 | −0.390 | 6.900 |
| −0.423 | −0.399 | 6.900 |

TABLE 2-continued

| X | Y | Z |
|---|---|---|
| −0.433 | −0.410 | 6.900 |
| −0.440 | −0.423 | 6.900 |
| −0.444 | −0.437 | 6.900 |
| −0.446 | −0.451 | 6.900 |
| −0.446 | −0.465 | 6.900 |
| −0.444 | −0.480 | 6.900 |
| −0.440 | −0.494 | 6.900 |
| −0.435 | −0.507 | 6.900 |
| −0.430 | −0.521 | 6.900 |
| −0.423 | −0.534 | 6.900 |
| SECTION 6 | | |
| −0.414 | −0.572 | 7.090 |
| −0.411 | −0.577 | 7.090 |
| −0.409 | −0.581 | 7.090 |
| −0.406 | −0.585 | 7.090 |
| −0.403 | −0.589 | 7.090 |
| −0.400 | −0.593 | 7.090 |
| −0.397 | −0.597 | 7.090 |
| −0.394 | −0.601 | 7.090 |
| −0.390 | −0.604 | 7.090 |
| −0.387 | −0.608 | 7.090 |
| −0.384 | −0.612 | 7.090 |
| −0.365 | −0.629 | 7.090 |
| −0.346 | −0.644 | 7.090 |
| −0.325 | −0.657 | 7.090 |
| −0.302 | −0.668 | 7.090 |
| −0.279 | −0.676 | 7.090 |
| −0.255 | −0.682 | 7.090 |
| −0.230 | −0.687 | 7.090 |
| −0.205 | −0.688 | 7.090 |
| −0.181 | −0.688 | 7.090 |
| −0.156 | −0.686 | 7.090 |
| −0.131 | −0.681 | 7.090 |
| −0.107 | −0.675 | 7.090 |
| −0.084 | −0.667 | 7.090 |
| −0.061 | −0.658 | 7.090 |
| −0.038 | −0.647 | 7.090 |
| −0.017 | −0.635 | 7.090 |
| 0.004 | −0.621 | 7.090 |
| 0.024 | −0.607 | 7.090 |
| 0.044 | −0.591 | 7.090 |
| 0.063 | −0.575 | 7.090 |
| 0.081 | −0.558 | 7.090 |
| 0.098 | −0.540 | 7.090 |
| 0.115 | −0.522 | 7.090 |
| 0.131 | −0.503 | 7.090 |
| 0.147 | −0.484 | 7.090 |
| 0.162 | −0.464 | 7.090 |
| 0.177 | −0.444 | 7.090 |
| 0.191 | −0.424 | 7.090 |
| 0.205 | −0.403 | 7.090 |
| 0.218 | −0.382 | 7.090 |
| 0.231 | −0.361 | 7.090 |
| 0.244 | −0.340 | 7.090 |
| 0.256 | −0.318 | 7.090 |
| 0.268 | −0.296 | 7.090 |
| 0.280 | −0.274 | 7.090 |
| 0.292 | −0.252 | 7.090 |
| 0.303 | −0.230 | 7.090 |
| 0.314 | −0.208 | 7.090 |
| 0.325 | −0.185 | 7.090 |
| 0.335 | −0.163 | 7.090 |
| 0.346 | −0.140 | 7.090 |
| 0.356 | −0.117 | 7.090 |
| 0.366 | −0.095 | 7.090 |
| 0.375 | −0.072 | 7.090 |
| 0.385 | −0.049 | 7.090 |
| 0.394 | −0.026 | 7.090 |
| 0.404 | −0.003 | 7.090 |
| 0.413 | 0.020 | 7.090 |
| 0.422 | 0.044 | 7.090 |
| 0.430 | 0.067 | 7.090 |
| 0.439 | 0.090 | 7.090 |
| 0.448 | 0.114 | 7.090 |
| 0.456 | 0.137 | 7.090 |
| 0.465 | 0.160 | 7.090 |
| 0.473 | 0.184 | 7.090 |

TABLE 2-continued

| X | Y | Z |
|---|---|---|
| 0.481 | 0.207 | 7.090 |
| 0.489 | 0.231 | 7.090 |
| 0.497 | 0.254 | 7.090 |
| 0.505 | 0.278 | 7.090 |
| 0.513 | 0.301 | 7.090 |
| 0.521 | 0.325 | 7.090 |
| 0.529 | 0.349 | 7.090 |
| 0.536 | 0.372 | 7.090 |
| 0.544 | 0.396 | 7.090 |
| 0.552 | 0.420 | 7.090 |
| 0.559 | 0.443 | 7.090 |
| 0.566 | 0.467 | 7.090 |
| 0.574 | 0.491 | 7.090 |
| 0.581 | 0.515 | 7.090 |
| 0.588 | 0.539 | 7.090 |
| 0.595 | 0.562 | 7.090 |
| 0.602 | 0.586 | 7.090 |
| 0.610 | 0.610 | 7.090 |
| 0.617 | 0.634 | 7.090 |
| 0.624 | 0.658 | 7.090 |
| 0.631 | 0.681 | 7.090 |
| 0.638 | 0.705 | 7.090 |
| 0.645 | 0.729 | 7.090 |
| 0.652 | 0.753 | 7.090 |
| 0.654 | 0.758 | 7.090 |
| 0.655 | 0.762 | 7.090 |
| 0.657 | 0.767 | 7.090 |
| 0.658 | 0.772 | 7.090 |
| 0.659 | 0.777 | 7.090 |
| 0.661 | 0.782 | 7.090 |
| 0.662 | 0.786 | 7.090 |
| 0.664 | 0.791 | 7.090 |
| 0.665 | 0.796 | 7.090 |
| 0.666 | 0.801 | 7.090 |
| 0.667 | 0.804 | 7.090 |
| 0.667 | 0.806 | 7.090 |
| 0.667 | 0.809 | 7.090 |
| 0.666 | 0.812 | 7.090 |
| 0.665 | 0.815 | 7.090 |
| 0.663 | 0.817 | 7.090 |
| 0.661 | 0.819 | 7.090 |
| 0.659 | 0.821 | 7.090 |
| 0.657 | 0.823 | 7.090 |
| 0.654 | 0.824 | 7.090 |
| 0.652 | 0.825 | 7.090 |
| 0.649 | 0.826 | 7.090 |
| 0.646 | 0.825 | 7.090 |
| 0.643 | 0.825 | 7.090 |
| 0.640 | 0.824 | 7.090 |
| 0.638 | 0.822 | 7.090 |
| 0.636 | 0.820 | 7.090 |
| 0.634 | 0.818 | 7.090 |
| 0.632 | 0.816 | 7.090 |
| 0.630 | 0.813 | 7.090 |
| 0.628 | 0.810 | 7.090 |
| 0.626 | 0.807 | 7.090 |
| 0.624 | 0.803 | 7.090 |
| 0.622 | 0.800 | 7.090 |
| 0.620 | 0.797 | 7.090 |
| 0.617 | 0.794 | 7.090 |
| 0.615 | 0.791 | 7.090 |
| 0.613 | 0.788 | 7.090 |
| 0.611 | 0.785 | 7.090 |
| 0.601 | 0.769 | 7.090 |
| 0.590 | 0.753 | 7.090 |
| 0.580 | 0.737 | 7.090 |
| 0.571 | 0.721 | 7.090 |
| 0.561 | 0.705 | 7.090 |
| 0.551 | 0.689 | 7.090 |
| 0.541 | 0.673 | 7.090 |
| 0.531 | 0.657 | 7.090 |
| 0.521 | 0.641 | 7.090 |
| 0.512 | 0.625 | 7.090 |
| 0.502 | 0.609 | 7.090 |
| 0.491 | 0.593 | 7.090 |
| 0.481 | 0.578 | 7.090 |
| 0.471 | 0.562 | 7.090 |
| 0.461 | 0.546 | 7.090 |

TABLE 2-continued

| X | Y | Z |
|---|---|---|
| 0.451 | 0.530 | 7.090 |
| 0.440 | 0.515 | 7.090 |
| 0.430 | 0.499 | 7.090 |
| 0.420 | 0.483 | 7.090 |
| 0.410 | 0.467 | 7.090 |
| 0.400 | 0.451 | 7.090 |
| 0.390 | 0.435 | 7.090 |
| 0.379 | 0.420 | 7.090 |
| 0.369 | 0.404 | 7.090 |
| 0.359 | 0.388 | 7.090 |
| 0.349 | 0.372 | 7.090 |
| 0.339 | 0.356 | 7.090 |
| 0.329 | 0.340 | 7.090 |
| 0.319 | 0.325 | 7.090 |
| 0.308 | 0.309 | 7.090 |
| 0.298 | 0.293 | 7.090 |
| 0.288 | 0.277 | 7.090 |
| 0.278 | 0.261 | 7.090 |
| 0.267 | 0.246 | 7.090 |
| 0.257 | 0.230 | 7.090 |
| 0.247 | 0.214 | 7.090 |
| 0.236 | 0.199 | 7.090 |
| 0.226 | 0.183 | 7.090 |
| 0.216 | 0.167 | 7.090 |
| 0.205 | 0.152 | 7.090 |
| 0.195 | 0.136 | 7.090 |
| 0.184 | 0.120 | 7.090 |
| 0.174 | 0.105 | 7.090 |
| 0.163 | 0.089 | 7.090 |
| 0.153 | 0.074 | 7.090 |
| 0.142 | 0.058 | 7.090 |
| 0.131 | 0.043 | 7.090 |
| 0.120 | 0.027 | 7.090 |
| 0.110 | 0.012 | 7.090 |
| 0.099 | −0.003 | 7.090 |
| 0.088 | −0.019 | 7.090 |
| 0.077 | −0.034 | 7.090 |
| 0.066 | −0.049 | 7.090 |
| 0.055 | −0.064 | 7.090 |
| 0.043 | −0.079 | 7.090 |
| 0.032 | −0.094 | 7.090 |
| 0.021 | −0.109 | 7.090 |
| 0.009 | −0.124 | 7.090 |
| −0.002 | −0.139 | 7.090 |
| −0.014 | −0.154 | 7.090 |
| −0.026 | −0.168 | 7.090 |
| −0.038 | −0.183 | 7.090 |
| −0.050 | −0.197 | 7.090 |
| −0.062 | −0.211 | 7.090 |
| −0.075 | −0.226 | 7.090 |
| −0.087 | −0.240 | 7.090 |
| −0.100 | −0.253 | 7.090 |
| −0.113 | −0.267 | 7.090 |
| −0.126 | −0.281 | 7.090 |
| −0.139 | −0.294 | 7.090 |
| −0.153 | −0.307 | 7.090 |
| −0.167 | −0.319 | 7.090 |
| −0.181 | −0.331 | 7.090 |
| −0.196 | −0.343 | 7.090 |
| −0.211 | −0.354 | 7.090 |
| −0.227 | −0.365 | 7.090 |
| −0.243 | −0.374 | 7.090 |
| −0.260 | −0.382 | 7.090 |
| −0.278 | −0.388 | 7.090 |
| −0.282 | −0.389 | 7.090 |
| −0.285 | −0.390 | 7.090 |
| −0.289 | −0.391 | 7.090 |
| −0.293 | −0.392 | 7.090 |
| −0.296 | −0.392 | 7.090 |
| −0.300 | −0.393 | 7.090 |
| −0.304 | −0.393 | 7.090 |
| −0.307 | −0.393 | 7.090 |
| −0.311 | −0.393 | 7.090 |
| −0.315 | −0.393 | 7.090 |
| −0.330 | −0.393 | 7.090 |
| −0.344 | −0.393 | 7.090 |
| −0.359 | −0.395 | 7.090 |
| −0.373 | −0.397 | 7.090 |

TABLE 2-continued

| X | Y | Z |
|---|---|---|
| −0.387 | −0.401 | 7.090 |
| −0.400 | −0.407 | 7.090 |
| −0.413 | −0.414 | 7.090 |
| −0.424 | −0.424 | 7.090 |
| −0.433 | −0.435 | 7.090 |
| −0.440 | −0.448 | 7.090 |
| −0.444 | −0.462 | 7.090 |
| −0.445 | −0.477 | 7.090 |
| −0.445 | −0.491 | 7.090 |
| −0.443 | −0.506 | 7.090 |
| −0.439 | −0.520 | 7.090 |
| −0.434 | −0.534 | 7.090 |
| −0.428 | −0.547 | 7.090 |
| −0.421 | −0.560 | 7.090 |
| | SECTION 7 | |
| −0.407 | −0.584 | 7.280 |
| −0.404 | −0.589 | 7.280 |
| −0.401 | −0.593 | 7.280 |
| −0.398 | −0.596 | 7.280 |
| −0.395 | −0.600 | 7.280 |
| −0.392 | −0.604 | 7.280 |
| −0.388 | −0.608 | 7.280 |
| −0.385 | −0.612 | 7.280 |
| −0.381 | −0.615 | 7.280 |
| −0.378 | −0.619 | 7.280 |
| −0.374 | −0.622 | 7.280 |
| −0.355 | −0.638 | 7.280 |
| −0.335 | −0.653 | 7.280 |
| −0.313 | −0.665 | 7.280 |
| −0.290 | −0.675 | 7.280 |
| −0.267 | −0.683 | 7.280 |
| −0.243 | −0.689 | 7.280 |
| −0.218 | −0.693 | 7.280 |
| −0.193 | −0.695 | 7.280 |
| −0.168 | −0.695 | 7.280 |
| −0.143 | −0.693 | 7.280 |
| −0.119 | −0.689 | 7.280 |
| −0.094 | −0.684 | 7.280 |
| −0.070 | −0.677 | 7.280 |
| −0.047 | −0.668 | 7.280 |
| −0.024 | −0.658 | 7.280 |
| −0.002 | −0.646 | 7.280 |
| 0.020 | −0.634 | 7.280 |
| 0.040 | −0.620 | 7.280 |
| 0.061 | −0.605 | 7.280 |
| 0.080 | −0.590 | 7.280 |
| 0.099 | −0.573 | 7.280 |
| 0.117 | −0.556 | 7.280 |
| 0.135 | −0.538 | 7.280 |
| 0.151 | −0.520 | 7.280 |
| 0.168 | −0.501 | 7.280 |
| 0.183 | −0.482 | 7.280 |
| 0.199 | −0.462 | 7.280 |
| 0.213 | −0.442 | 7.280 |
| 0.227 | −0.421 | 7.280 |
| 0.241 | −0.400 | 7.280 |
| 0.254 | −0.379 | 7.280 |
| 0.267 | −0.358 | 7.280 |
| 0.280 | −0.336 | 7.280 |
| 0.292 | −0.314 | 7.280 |
| 0.304 | −0.292 | 7.280 |
| 0.315 | −0.270 | 7.280 |
| 0.326 | −0.248 | 7.280 |
| 0.337 | −0.225 | 7.280 |
| 0.348 | −0.203 | 7.280 |
| 0.358 | −0.180 | 7.280 |
| 0.368 | −0.157 | 7.280 |
| 0.378 | −0.134 | 7.280 |
| 0.388 | −0.111 | 7.280 |
| 0.397 | −0.088 | 7.280 |
| 0.407 | −0.065 | 7.280 |
| 0.416 | −0.042 | 7.280 |
| 0.425 | −0.018 | 7.280 |
| 0.433 | 0.005 | 7.280 |
| 0.442 | 0.029 | 7.280 |
| 0.451 | 0.052 | 7.280 |
| 0.459 | 0.076 | 7.280 |

TABLE 2-continued

| X | Y | Z |
|---|---|---|
| 0.467 | 0.099 | 7.280 |
| 0.475 | 0.123 | 7.280 |
| 0.483 | 0.146 | 7.280 |
| 0.491 | 0.170 | 7.280 |
| 0.499 | 0.194 | 7.280 |
| 0.507 | 0.217 | 7.280 |
| 0.514 | 0.241 | 7.280 |
| 0.522 | 0.265 | 7.280 |
| 0.529 | 0.289 | 7.280 |
| 0.537 | 0.313 | 7.280 |
| 0.544 | 0.336 | 7.280 |
| 0.551 | 0.360 | 7.280 |
| 0.559 | 0.384 | 7.280 |
| 0.566 | 0.408 | 7.280 |
| 0.573 | 0.432 | 7.280 |
| 0.580 | 0.456 | 7.280 |
| 0.587 | 0.480 | 7.280 |
| 0.594 | 0.504 | 7.280 |
| 0.601 | 0.528 | 7.280 |
| 0.608 | 0.552 | 7.280 |
| 0.614 | 0.576 | 7.280 |
| 0.621 | 0.600 | 7.280 |
| 0.628 | 0.624 | 7.280 |
| 0.635 | 0.648 | 7.280 |
| 0.642 | 0.672 | 7.280 |
| 0.649 | 0.696 | 7.280 |
| 0.655 | 0.720 | 7.280 |
| 0.662 | 0.744 | 7.280 |
| 0.663 | 0.749 | 7.280 |
| 0.665 | 0.754 | 7.280 |
| 0.666 | 0.759 | 7.280 |
| 0.667 | 0.763 | 7.280 |
| 0.669 | 0.768 | 7.280 |
| 0.670 | 0.773 | 7.280 |
| 0.671 | 0.778 | 7.280 |
| 0.673 | 0.783 | 7.280 |
| 0.674 | 0.788 | 7.280 |
| 0.675 | 0.792 | 7.280 |
| 0.676 | 0.795 | 7.280 |
| 0.676 | 0.798 | 7.280 |
| 0.676 | 0.801 | 7.280 |
| 0.675 | 0.804 | 7.280 |
| 0.674 | 0.807 | 7.280 |
| 0.672 | 0.809 | 7.280 |
| 0.670 | 0.811 | 7.280 |
| 0.668 | 0.813 | 7.280 |
| 0.666 | 0.815 | 7.280 |
| 0.663 | 0.816 | 7.280 |
| 0.660 | 0.817 | 7.280 |
| 0.657 | 0.817 | 7.280 |
| 0.655 | 0.817 | 7.280 |
| 0.652 | 0.816 | 7.280 |
| 0.649 | 0.815 | 7.280 |
| 0.647 | 0.813 | 7.280 |
| 0.644 | 0.812 | 7.280 |
| 0.642 | 0.809 | 7.280 |
| 0.641 | 0.807 | 7.280 |
| 0.639 | 0.804 | 7.280 |
| 0.637 | 0.801 | 7.280 |
| 0.635 | 0.798 | 7.280 |
| 0.633 | 0.794 | 7.280 |
| 0.631 | 0.791 | 7.280 |
| 0.629 | 0.788 | 7.280 |
| 0.626 | 0.785 | 7.280 |
| 0.624 | 0.782 | 7.280 |
| 0.622 | 0.778 | 7.280 |
| 0.620 | 0.775 | 7.280 |
| 0.610 | 0.759 | 7.280 |
| 0.600 | 0.743 | 7.280 |
| 0.590 | 0.727 | 7.280 |
| 0.581 | 0.711 | 7.280 |
| 0.571 | 0.694 | 7.280 |
| 0.562 | 0.678 | 7.280 |
| 0.552 | 0.662 | 7.280 |
| 0.542 | 0.645 | 7.280 |
| 0.533 | 0.629 | 7.280 |
| 0.523 | 0.613 | 7.280 |
| 0.513 | 0.597 | 7.280 |

TABLE 2-continued

| X | Y | Z |
|---|---|---|
| 0.503 | 0.581 | 7.280 |
| 0.493 | 0.565 | 7.280 |
| 0.483 | 0.549 | 7.280 |
| 0.473 | 0.532 | 7.280 |
| 0.463 | 0.516 | 7.280 |
| 0.453 | 0.501 | 7.280 |
| 0.443 | 0.484 | 7.280 |
| 0.433 | 0.468 | 7.280 |
| 0.423 | 0.452 | 7.280 |
| 0.413 | 0.436 | 7.280 |
| 0.403 | 0.420 | 7.280 |
| 0.393 | 0.404 | 7.280 |
| 0.383 | 0.388 | 7.280 |
| 0.373 | 0.372 | 7.280 |
| 0.363 | 0.356 | 7.280 |
| 0.352 | 0.340 | 7.280 |
| 0.342 | 0.324 | 7.280 |
| 0.332 | 0.308 | 7.280 |
| 0.322 | 0.292 | 7.280 |
| 0.312 | 0.276 | 7.280 |
| 0.302 | 0.260 | 7.280 |
| 0.291 | 0.244 | 7.280 |
| 0.281 | 0.228 | 7.280 |
| 0.271 | 0.212 | 7.280 |
| 0.260 | 0.197 | 7.280 |
| 0.250 | 0.181 | 7.280 |
| 0.239 | 0.165 | 7.280 |
| 0.229 | 0.149 | 7.280 |
| 0.218 | 0.134 | 7.280 |
| 0.208 | 0.118 | 7.280 |
| 0.197 | 0.102 | 7.280 |
| 0.187 | 0.087 | 7.280 |
| 0.176 | 0.071 | 7.280 |
| 0.165 | 0.055 | 7.280 |
| 0.154 | 0.040 | 7.280 |
| 0.143 | 0.025 | 7.280 |
| 0.132 | 0.009 | 7.280 |
| 0.121 | −0.006 | 7.280 |
| 0.110 | −0.022 | 7.280 |
| 0.099 | −0.037 | 7.280 |
| 0.087 | −0.052 | 7.280 |
| 0.076 | −0.067 | 7.280 |
| 0.064 | −0.082 | 7.280 |
| 0.053 | −0.097 | 7.280 |
| 0.041 | −0.112 | 7.280 |
| 0.029 | −0.126 | 7.280 |
| 0.017 | −0.141 | 7.280 |
| 0.005 | −0.156 | 7.280 |
| −0.007 | −0.170 | 7.280 |
| −0.020 | −0.184 | 7.280 |
| −0.032 | −0.198 | 7.280 |
| −0.045 | −0.213 | 7.280 |
| −0.058 | −0.226 | 7.280 |
| −0.071 | −0.240 | 7.280 |
| −0.084 | −0.254 | 7.280 |
| −0.098 | −0.267 | 7.280 |
| −0.112 | −0.280 | 7.280 |
| −0.126 | −0.293 | 7.280 |
| −0.140 | −0.305 | 7.280 |
| −0.155 | −0.317 | 7.280 |
| −0.169 | −0.329 | 7.280 |
| −0.185 | −0.340 | 7.280 |
| −0.200 | −0.350 | 7.280 |
| −0.217 | −0.360 | 7.280 |
| −0.233 | −0.369 | 7.280 |
| −0.250 | −0.378 | 7.280 |
| −0.268 | −0.384 | 7.280 |
| −0.286 | −0.390 | 7.280 |
| −0.290 | −0.391 | 7.280 |
| −0.293 | −0.392 | 7.280 |
| −0.297 | −0.392 | 7.280 |
| −0.301 | −0.393 | 7.280 |
| −0.305 | −0.394 | 7.280 |
| −0.308 | −0.394 | 7.280 |
| −0.312 | −0.394 | 7.280 |
| −0.316 | −0.395 | 7.280 |
| −0.320 | −0.395 | 7.280 |
| −0.323 | −0.395 | 7.280 |

TABLE 2-continued

| X | Y | Z |
|---|---|---|
| −0.338 | −0.395 | 7.280 |
| −0.353 | −0.397 | 7.280 |
| −0.367 | −0.399 | 7.280 |
| −0.382 | −0.403 | 7.280 |
| −0.395 | −0.408 | 7.280 |
| −0.408 | −0.415 | 7.280 |
| −0.420 | −0.424 | 7.280 |
| −0.430 | −0.435 | 7.280 |
| −0.438 | −0.447 | 7.280 |
| −0.443 | −0.461 | 7.280 |
| −0.445 | −0.475 | 7.280 |
| −0.445 | −0.490 | 7.280 |
| −0.443 | −0.505 | 7.280 |
| −0.440 | −0.519 | 7.280 |
| −0.435 | −0.533 | 7.280 |
| −0.429 | −0.546 | 7.280 |
| −0.423 | −0.559 | 7.280 |
| −0.415 | −0.572 | 7.280 |
| SECTION 8 | | |
| −0.402 | −0.580 | 7.470 |
| −0.399 | −0.584 | 7.470 |
| −0.396 | −0.588 | 7.470 |
| −0.393 | −0.592 | 7.470 |
| −0.390 | −0.595 | 7.470 |
| −0.386 | −0.599 | 7.470 |
| −0.383 | −0.603 | 7.470 |
| −0.379 | −0.606 | 7.470 |
| −0.376 | −0.610 | 7.470 |
| −0.372 | −0.613 | 7.470 |
| −0.369 | −0.617 | 7.470 |
| −0.349 | −0.633 | 7.470 |
| −0.328 | −0.647 | 7.470 |
| −0.306 | −0.659 | 7.470 |
| −0.283 | −0.669 | 7.470 |
| −0.260 | −0.677 | 7.470 |
| −0.235 | −0.683 | 7.470 |
| −0.211 | −0.687 | 7.470 |
| −0.186 | −0.689 | 7.470 |
| −0.160 | −0.690 | 7.470 |
| −0.135 | −0.688 | 7.470 |
| −0.110 | −0.685 | 7.470 |
| −0.086 | −0.680 | 7.470 |
| −0.062 | −0.673 | 7.470 |
| −0.038 | −0.665 | 7.470 |
| −0.015 | −0.655 | 7.470 |
| 0.008 | −0.644 | 7.470 |
| 0.030 | −0.632 | 7.470 |
| 0.051 | −0.619 | 7.470 |
| 0.072 | −0.605 | 7.470 |
| 0.092 | −0.590 | 7.470 |
| 0.111 | −0.573 | 7.470 |
| 0.130 | −0.557 | 7.470 |
| 0.147 | −0.539 | 7.470 |
| 0.165 | −0.521 | 7.470 |
| 0.181 | −0.502 | 7.470 |
| 0.198 | −0.483 | 7.470 |
| 0.213 | −0.463 | 7.470 |
| 0.228 | −0.443 | 7.470 |
| 0.243 | −0.423 | 7.470 |
| 0.257 | −0.402 | 7.470 |
| 0.270 | −0.381 | 7.470 |
| 0.284 | −0.359 | 7.470 |
| 0.296 | −0.338 | 7.470 |
| 0.309 | −0.316 | 7.470 |
| 0.321 | −0.294 | 7.470 |
| 0.332 | −0.272 | 7.470 |
| 0.344 | −0.249 | 7.470 |
| 0.355 | −0.227 | 7.470 |
| 0.365 | −0.204 | 7.470 |
| 0.376 | −0.181 | 7.470 |
| 0.386 | −0.158 | 7.470 |
| 0.396 | −0.135 | 7.470 |
| 0.406 | −0.112 | 7.470 |
| 0.415 | −0.089 | 7.470 |
| 0.424 | −0.065 | 7.470 |
| 0.433 | −0.042 | 7.470 |
| 0.442 | −0.019 | 7.470 |

TABLE 2-continued

| X | Y | Z |
|---|---|---|
| 0.451 | 0.005 | 7.470 |
| 0.459 | 0.029 | 7.470 |
| 0.468 | 0.052 | 7.470 |
| 0.476 | 0.076 | 7.470 |
| 0.484 | 0.100 | 7.470 |
| 0.492 | 0.124 | 7.470 |
| 0.500 | 0.147 | 7.470 |
| 0.507 | 0.171 | 7.470 |
| 0.515 | 0.195 | 7.470 |
| 0.523 | 0.219 | 7.470 |
| 0.530 | 0.243 | 7.470 |
| 0.537 | 0.267 | 7.470 |
| 0.545 | 0.291 | 7.470 |
| 0.552 | 0.315 | 7.470 |
| 0.559 | 0.339 | 7.470 |
| 0.566 | 0.363 | 7.470 |
| 0.573 | 0.387 | 7.470 |
| 0.580 | 0.411 | 7.470 |
| 0.587 | 0.436 | 7.470 |
| 0.594 | 0.460 | 7.470 |
| 0.601 | 0.484 | 7.470 |
| 0.607 | 0.508 | 7.470 |
| 0.614 | 0.532 | 7.470 |
| 0.620 | 0.557 | 7.470 |
| 0.627 | 0.581 | 7.470 |
| 0.634 | 0.605 | 7.470 |
| 0.640 | 0.629 | 7.470 |
| 0.647 | 0.653 | 7.470 |
| 0.653 | 0.678 | 7.470 |
| 0.660 | 0.702 | 7.470 |
| 0.666 | 0.726 | 7.470 |
| 0.673 | 0.750 | 7.470 |
| 0.674 | 0.755 | 7.470 |
| 0.675 | 0.760 | 7.470 |
| 0.676 | 0.765 | 7.470 |
| 0.678 | 0.770 | 7.470 |
| 0.679 | 0.775 | 7.470 |
| 0.680 | 0.780 | 7.470 |
| 0.681 | 0.784 | 7.470 |
| 0.683 | 0.789 | 7.470 |
| 0.684 | 0.794 | 7.470 |
| 0.685 | 0.799 | 7.470 |
| 0.686 | 0.802 | 7.470 |
| 0.686 | 0.805 | 7.470 |
| 0.685 | 0.808 | 7.470 |
| 0.685 | 0.810 | 7.470 |
| 0.683 | 0.813 | 7.470 |
| 0.682 | 0.816 | 7.470 |
| 0.680 | 0.818 | 7.470 |
| 0.678 | 0.820 | 7.470 |
| 0.675 | 0.821 | 7.470 |
| 0.673 | 0.823 | 7.470 |
| 0.670 | 0.823 | 7.470 |
| 0.667 | 0.824 | 7.470 |
| 0.664 | 0.823 | 7.470 |
| 0.661 | 0.823 | 7.470 |
| 0.659 | 0.821 | 7.470 |
| 0.656 | 0.820 | 7.470 |
| 0.654 | 0.818 | 7.470 |
| 0.652 | 0.816 | 7.470 |
| 0.651 | 0.813 | 7.470 |
| 0.649 | 0.810 | 7.470 |
| 0.647 | 0.807 | 7.470 |
| 0.645 | 0.804 | 7.470 |
| 0.643 | 0.800 | 7.470 |
| 0.641 | 0.797 | 7.470 |
| 0.639 | 0.794 | 7.470 |
| 0.637 | 0.791 | 7.470 |
| 0.635 | 0.787 | 7.470 |
| 0.633 | 0.784 | 7.470 |
| 0.631 | 0.781 | 7.470 |
| 0.621 | 0.765 | 7.470 |
| 0.611 | 0.748 | 7.470 |
| 0.601 | 0.732 | 7.470 |
| 0.592 | 0.715 | 7.470 |
| 0.582 | 0.699 | 7.470 |
| 0.573 | 0.682 | 7.470 |
| 0.564 | 0.665 | 7.470 |

TABLE 2-continued

| X | Y | Z |
|---|---|---|
| 0.554 | 0.649 | 7.470 |
| 0.544 | 0.633 | 7.470 |
| 0.535 | 0.616 | 7.470 |
| 0.525 | 0.600 | 7.470 |
| 0.515 | 0.583 | 7.470 |
| 0.505 | 0.567 | 7.470 |
| 0.496 | 0.551 | 7.470 |
| 0.486 | 0.534 | 7.470 |
| 0.476 | 0.518 | 7.470 |
| 0.466 | 0.502 | 7.470 |
| 0.456 | 0.486 | 7.470 |
| 0.446 | 0.469 | 7.470 |
| 0.436 | 0.453 | 7.470 |
| 0.426 | 0.437 | 7.470 |
| 0.416 | 0.420 | 7.470 |
| 0.406 | 0.404 | 7.470 |
| 0.396 | 0.388 | 7.470 |
| 0.386 | 0.372 | 7.470 |
| 0.376 | 0.356 | 7.470 |
| 0.366 | 0.339 | 7.470 |
| 0.356 | 0.323 | 7.470 |
| 0.345 | 0.307 | 7.470 |
| 0.335 | 0.291 | 7.470 |
| 0.325 | 0.275 | 7.470 |
| 0.315 | 0.259 | 7.470 |
| 0.305 | 0.243 | 7.470 |
| 0.294 | 0.227 | 7.470 |
| 0.284 | 0.211 | 7.470 |
| 0.273 | 0.195 | 7.470 |
| 0.263 | 0.179 | 7.470 |
| 0.252 | 0.163 | 7.470 |
| 0.242 | 0.147 | 7.470 |
| 0.231 | 0.131 | 7.470 |
| 0.220 | 0.115 | 7.470 |
| 0.210 | 0.100 | 7.470 |
| 0.199 | 0.084 | 7.470 |
| 0.188 | 0.068 | 7.470 |
| 0.177 | 0.053 | 7.470 |
| 0.166 | 0.037 | 7.470 |
| 0.155 | 0.022 | 7.470 |
| 0.143 | 0.006 | 7.470 |
| 0.132 | −0.009 | 7.470 |
| 0.121 | −0.024 | 7.470 |
| 0.109 | −0.039 | 7.470 |
| 0.097 | −0.055 | 7.470 |
| 0.086 | −0.070 | 7.470 |
| 0.074 | −0.084 | 7.470 |
| 0.062 | −0.099 | 7.470 |
| 0.050 | −0.114 | 7.470 |
| 0.037 | −0.129 | 7.470 |
| 0.025 | −0.143 | 7.470 |
| 0.012 | −0.157 | 7.470 |
| 0.000 | −0.172 | 7.470 |
| −0.013 | −0.186 | 7.470 |
| −0.026 | −0.199 | 7.470 |
| −0.040 | −0.213 | 7.470 |
| −0.053 | −0.227 | 7.470 |
| −0.067 | −0.240 | 7.470 |
| −0.081 | −0.253 | 7.470 |
| −0.095 | −0.266 | 7.470 |
| −0.109 | −0.278 | 7.470 |
| −0.124 | −0.291 | 7.470 |
| −0.139 | −0.302 | 7.470 |
| −0.154 | −0.314 | 7.470 |
| −0.170 | −0.325 | 7.470 |
| −0.186 | −0.335 | 7.470 |
| −0.202 | −0.345 | 7.470 |
| −0.219 | −0.353 | 7.470 |
| −0.236 | −0.361 | 7.470 |
| −0.254 | −0.369 | 7.470 |
| −0.272 | −0.375 | 7.470 |
| −0.291 | −0.379 | 7.470 |
| −0.294 | −0.380 | 7.470 |
| −0.298 | −0.381 | 7.470 |
| −0.302 | −0.381 | 7.470 |
| −0.306 | −0.382 | 7.470 |
| −0.310 | −0.383 | 7.470 |
| −0.313 | −0.383 | 7.470 |

TABLE 2-continued

| X | Y | Z |
|---|---|---|
| −0.317 | −0.383 | 7.470 |
| −0.321 | −0.384 | 7.470 |
| −0.325 | −0.384 | 7.470 |
| −0.329 | −0.384 | 7.470 |
| −0.343 | −0.385 | 7.470 |
| −0.358 | −0.387 | 7.470 |
| −0.373 | −0.390 | 7.470 |
| −0.387 | −0.394 | 7.470 |
| −0.400 | −0.400 | 7.470 |
| −0.413 | −0.408 | 7.470 |
| −0.424 | −0.418 | 7.470 |
| −0.433 | −0.429 | 7.470 |
| −0.440 | −0.443 | 7.470 |
| −0.444 | −0.457 | 7.470 |
| −0.446 | −0.472 | 7.470 |
| −0.445 | −0.486 | 7.470 |
| −0.442 | −0.501 | 7.470 |
| −0.438 | −0.515 | 7.470 |
| −0.433 | −0.529 | 7.470 |
| −0.426 | −0.542 | 7.470 |
| −0.419 | −0.555 | 7.470 |
| −0.411 | −0.568 | 7.470 |
| | SECTION 9 | |
| −0.404 | −0.559 | 7.660 |
| −0.401 | −0.563 | 7.660 |
| −0.398 | −0.567 | 7.660 |
| −0.395 | −0.571 | 7.660 |
| −0.392 | −0.575 | 7.660 |
| −0.388 | −0.579 | 7.660 |
| −0.385 | −0.582 | 7.660 |
| −0.381 | −0.586 | 7.660 |
| −0.378 | −0.590 | 7.660 |
| −0.374 | −0.593 | 7.660 |
| −0.370 | −0.597 | 7.660 |
| −0.351 | −0.613 | 7.660 |
| −0.330 | −0.628 | 7.660 |
| −0.308 | −0.640 | 7.660 |
| −0.285 | −0.651 | 7.660 |
| −0.262 | −0.660 | 7.660 |
| −0.237 | −0.667 | 7.660 |
| −0.212 | −0.671 | 7.660 |
| −0.187 | −0.674 | 7.660 |
| −0.162 | −0.675 | 7.660 |
| −0.137 | −0.674 | 7.660 |
| −0.111 | −0.671 | 7.660 |
| −0.086 | −0.666 | 7.660 |
| −0.062 | −0.660 | 7.660 |
| −0.038 | −0.652 | 7.660 |
| −0.014 | −0.642 | 7.660 |
| 0.009 | −0.631 | 7.660 |
| 0.031 | −0.619 | 7.660 |
| 0.052 | −0.606 | 7.660 |
| 0.073 | −0.591 | 7.660 |
| 0.093 | −0.576 | 7.660 |
| 0.113 | −0.560 | 7.660 |
| 0.131 | −0.543 | 7.660 |
| 0.150 | −0.525 | 7.660 |
| 0.167 | −0.507 | 7.660 |
| 0.184 | −0.488 | 7.660 |
| 0.200 | −0.469 | 7.660 |
| 0.216 | −0.449 | 7.660 |
| 0.232 | −0.429 | 7.660 |
| 0.246 | −0.408 | 7.660 |
| 0.261 | −0.387 | 7.660 |
| 0.275 | −0.366 | 7.660 |
| 0.288 | −0.344 | 7.660 |
| 0.301 | −0.323 | 7.660 |
| 0.314 | −0.301 | 7.660 |
| 0.326 | −0.279 | 7.660 |
| 0.338 | −0.256 | 7.660 |
| 0.350 | −0.234 | 7.660 |
| 0.361 | −0.211 | 7.660 |
| 0.372 | −0.188 | 7.660 |
| 0.383 | −0.165 | 7.660 |
| 0.394 | −0.142 | 7.660 |
| 0.404 | −0.119 | 7.660 |
| 0.414 | −0.096 | 7.660 |

TABLE 2-continued

| X | Y | Z |
|---|---|---|
| 0.423 | −0.072 | 7.660 |
| 0.433 | −0.049 | 7.660 |
| 0.442 | −0.025 | 7.660 |
| 0.451 | −0.002 | 7.660 |
| 0.460 | 0.022 | 7.660 |
| 0.469 | 0.046 | 7.660 |
| 0.478 | 0.070 | 7.660 |
| 0.486 | 0.094 | 7.660 |
| 0.494 | 0.118 | 7.660 |
| 0.503 | 0.142 | 7.660 |
| 0.511 | 0.166 | 7.660 |
| 0.518 | 0.190 | 7.660 |
| 0.526 | 0.214 | 7.660 |
| 0.534 | 0.238 | 7.660 |
| 0.542 | 0.262 | 7.660 |
| 0.549 | 0.286 | 7.660 |
| 0.557 | 0.311 | 7.660 |
| 0.564 | 0.335 | 7.660 |
| 0.571 | 0.359 | 7.660 |
| 0.578 | 0.383 | 7.660 |
| 0.585 | 0.408 | 7.660 |
| 0.592 | 0.432 | 7.660 |
| 0.599 | 0.457 | 7.660 |
| 0.606 | 0.481 | 7.660 |
| 0.613 | 0.505 | 7.660 |
| 0.619 | 0.530 | 7.660 |
| 0.626 | 0.554 | 7.660 |
| 0.633 | 0.579 | 7.660 |
| 0.639 | 0.603 | 7.660 |
| 0.646 | 0.628 | 7.660 |
| 0.652 | 0.652 | 7.660 |
| 0.659 | 0.677 | 7.660 |
| 0.665 | 0.701 | 7.660 |
| 0.671 | 0.726 | 7.660 |
| 0.678 | 0.751 | 7.660 |
| 0.684 | 0.775 | 7.660 |
| 0.685 | 0.780 | 7.660 |
| 0.686 | 0.785 | 7.660 |
| 0.687 | 0.790 | 7.660 |
| 0.689 | 0.795 | 7.660 |
| 0.690 | 0.800 | 7.660 |
| 0.691 | 0.805 | 7.660 |
| 0.692 | 0.810 | 7.660 |
| 0.693 | 0.814 | 7.660 |
| 0.695 | 0.819 | 7.660 |
| 0.696 | 0.824 | 7.660 |
| 0.696 | 0.827 | 7.660 |
| 0.696 | 0.830 | 7.660 |
| 0.696 | 0.833 | 7.660 |
| 0.695 | 0.836 | 7.660 |
| 0.694 | 0.839 | 7.660 |
| 0.693 | 0.841 | 7.660 |
| 0.691 | 0.843 | 7.660 |
| 0.688 | 0.845 | 7.660 |
| 0.686 | 0.847 | 7.660 |
| 0.683 | 0.848 | 7.660 |
| 0.681 | 0.849 | 7.660 |
| 0.678 | 0.849 | 7.660 |
| 0.675 | 0.849 | 7.660 |
| 0.672 | 0.848 | 7.660 |
| 0.669 | 0.847 | 7.660 |
| 0.667 | 0.845 | 7.660 |
| 0.665 | 0.843 | 7.660 |
| 0.663 | 0.841 | 7.660 |
| 0.661 | 0.838 | 7.660 |
| 0.659 | 0.835 | 7.660 |
| 0.657 | 0.832 | 7.660 |
| 0.655 | 0.829 | 7.660 |
| 0.653 | 0.825 | 7.660 |
| 0.651 | 0.822 | 7.660 |
| 0.649 | 0.819 | 7.660 |
| 0.647 | 0.815 | 7.660 |
| 0.645 | 0.812 | 7.660 |
| 0.643 | 0.809 | 7.660 |
| 0.641 | 0.805 | 7.660 |
| 0.632 | 0.789 | 7.660 |
| 0.622 | 0.772 | 7.660 |
| 0.612 | 0.756 | 7.660 |

TABLE 2-continued

| X | Y | Z |
|---|---|---|
| 0.603 | 0.739 | 7.660 |
| 0.594 | 0.722 | 7.660 |
| 0.584 | 0.705 | 7.660 |
| 0.575 | 0.689 | 7.660 |
| 0.565 | 0.672 | 7.660 |
| 0.556 | 0.655 | 7.660 |
| 0.546 | 0.639 | 7.660 |
| 0.536 | 0.622 | 7.660 |
| 0.527 | 0.606 | 7.660 |
| 0.517 | 0.589 | 7.660 |
| 0.507 | 0.573 | 7.660 |
| 0.497 | 0.556 | 7.660 |
| 0.487 | 0.540 | 7.660 |
| 0.477 | 0.523 | 7.660 |
| 0.467 | 0.507 | 7.660 |
| 0.457 | 0.491 | 7.660 |
| 0.447 | 0.474 | 7.660 |
| 0.437 | 0.458 | 7.660 |
| 0.427 | 0.441 | 7.660 |
| 0.417 | 0.425 | 7.660 |
| 0.407 | 0.409 | 7.660 |
| 0.397 | 0.392 | 7.660 |
| 0.387 | 0.376 | 7.660 |
| 0.377 | 0.360 | 7.660 |
| 0.367 | 0.343 | 7.660 |
| 0.356 | 0.327 | 7.660 |
| 0.346 | 0.311 | 7.660 |
| 0.336 | 0.295 | 7.660 |
| 0.325 | 0.279 | 7.660 |
| 0.315 | 0.262 | 7.660 |
| 0.305 | 0.246 | 7.660 |
| 0.294 | 0.230 | 7.660 |
| 0.284 | 0.214 | 7.660 |
| 0.273 | 0.198 | 7.660 |
| 0.262 | 0.182 | 7.660 |
| 0.252 | 0.166 | 7.660 |
| 0.241 | 0.150 | 7.660 |
| 0.230 | 0.134 | 7.660 |
| 0.219 | 0.119 | 7.660 |
| 0.208 | 0.103 | 7.660 |
| 0.197 | 0.087 | 7.660 |
| 0.186 | 0.071 | 7.660 |
| 0.175 | 0.056 | 7.660 |
| 0.164 | 0.040 | 7.660 |
| 0.153 | 0.025 | 7.660 |
| 0.141 | 0.009 | 7.660 |
| 0.130 | −0.006 | 7.660 |
| 0.118 | −0.021 | 7.660 |
| 0.106 | −0.037 | 7.660 |
| 0.094 | −0.052 | 7.660 |
| 0.082 | −0.067 | 7.660 |
| 0.070 | −0.082 | 7.660 |
| 0.058 | −0.096 | 7.660 |
| 0.046 | −0.111 | 7.660 |
| 0.033 | −0.126 | 7.660 |
| 0.020 | −0.140 | 7.660 |
| 0.008 | −0.154 | 7.660 |
| −0.005 | −0.168 | 7.660 |
| −0.019 | −0.182 | 7.660 |
| −0.032 | −0.196 | 7.660 |
| −0.046 | −0.210 | 7.660 |
| −0.059 | −0.223 | 7.660 |
| −0.073 | −0.236 | 7.660 |
| −0.088 | −0.249 | 7.660 |
| −0.102 | −0.262 | 7.660 |
| −0.117 | −0.274 | 7.660 |
| −0.132 | −0.286 | 7.660 |
| −0.148 | −0.297 | 7.660 |
| −0.163 | −0.308 | 7.660 |
| −0.180 | −0.318 | 7.660 |
| −0.196 | −0.328 | 7.660 |
| −0.213 | −0.337 | 7.660 |
| −0.231 | −0.344 | 7.660 |
| −0.249 | −0.351 | 7.660 |
| −0.267 | −0.357 | 7.660 |
| −0.286 | −0.362 | 7.660 |
| −0.289 | −0.363 | 7.660 |
| −0.293 | −0.363 | 7.660 |

TABLE 2-continued

| X | Y | Z |
|---|---|---|
| −0.297 | −0.364 | 7.660 |
| −0.301 | −0.364 | 7.660 |
| −0.305 | −0.365 | 7.660 |
| −0.308 | −0.365 | 7.660 |
| −0.312 | −0.366 | 7.660 |
| −0.316 | −0.366 | 7.660 |
| −0.320 | −0.366 | 7.660 |
| −0.324 | −0.366 | 7.660 |
| −0.339 | −0.367 | 7.660 |
| −0.353 | −0.369 | 7.660 |
| −0.368 | −0.372 | 7.660 |
| −0.382 | −0.376 | 7.660 |
| −0.396 | −0.381 | 7.660 |
| −0.409 | −0.389 | 7.660 |
| −0.421 | −0.398 | 7.660 |
| −0.431 | −0.409 | 7.660 |
| −0.438 | −0.422 | 7.660 |
| −0.443 | −0.436 | 7.660 |
| −0.446 | −0.450 | 7.660 |
| −0.446 | −0.465 | 7.660 |
| −0.444 | −0.480 | 7.660 |
| −0.440 | −0.494 | 7.660 |
| −0.435 | −0.508 | 7.660 |
| −0.428 | −0.522 | 7.660 |
| −0.421 | −0.535 | 7.660 |
| −0.413 | −0.547 | 7.660 |
| SECTION 10 | | |
| −0.407 | −0.527 | 7.850 |
| −0.404 | −0.531 | 7.850 |
| −0.400 | −0.534 | 7.850 |
| −0.397 | −0.538 | 7.850 |
| −0.394 | −0.542 | 7.850 |
| −0.390 | −0.546 | 7.850 |
| −0.387 | −0.550 | 7.850 |
| −0.383 | −0.554 | 7.850 |
| −0.380 | −0.557 | 7.850 |
| −0.376 | −0.561 | 7.850 |
| −0.372 | −0.564 | 7.850 |
| −0.353 | −0.581 | 7.850 |
| −0.332 | −0.596 | 7.850 |
| −0.310 | −0.609 | 7.850 |
| −0.288 | −0.621 | 7.850 |
| −0.264 | −0.630 | 7.850 |
| −0.239 | −0.638 | 7.850 |
| −0.214 | −0.643 | 7.850 |
| −0.189 | −0.647 | 7.850 |
| −0.164 | −0.648 | 7.850 |
| −0.138 | −0.647 | 7.850 |
| −0.113 | −0.645 | 7.850 |
| −0.087 | −0.641 | 7.850 |
| −0.062 | −0.635 | 7.850 |
| −0.038 | −0.627 | 7.850 |
| −0.014 | −0.617 | 7.850 |
| 0.009 | −0.606 | 7.850 |
| 0.031 | −0.594 | 7.850 |
| 0.053 | −0.581 | 7.850 |
| 0.074 | −0.566 | 7.850 |
| 0.094 | −0.551 | 7.850 |
| 0.114 | −0.534 | 7.850 |
| 0.133 | −0.517 | 7.850 |
| 0.151 | −0.499 | 7.850 |
| 0.169 | −0.481 | 7.850 |
| 0.186 | −0.462 | 7.850 |
| 0.203 | −0.442 | 7.850 |
| 0.219 | −0.422 | 7.850 |
| 0.234 | −0.402 | 7.850 |
| 0.249 | −0.381 | 7.850 |
| 0.264 | −0.360 | 7.850 |
| 0.278 | −0.339 | 7.850 |
| 0.292 | −0.318 | 7.850 |
| 0.305 | −0.296 | 7.850 |
| 0.318 | −0.274 | 7.850 |
| 0.331 | −0.252 | 7.850 |
| 0.343 | −0.229 | 7.850 |
| 0.355 | −0.207 | 7.850 |
| 0.367 | −0.184 | 7.850 |
| 0.378 | −0.161 | 7.850 |

TABLE 2-continued

| X | Y | Z |
|---|---|---|
| 0.389 | −0.138 | 7.850 |
| 0.400 | −0.115 | 7.850 |
| 0.411 | −0.091 | 7.850 |
| 0.421 | −0.068 | 7.850 |
| 0.431 | −0.044 | 7.850 |
| 0.441 | −0.021 | 7.850 |
| 0.450 | 0.003 | 7.850 |
| 0.460 | 0.027 | 7.850 |
| 0.469 | 0.051 | 7.850 |
| 0.478 | 0.074 | 7.850 |
| 0.487 | 0.098 | 7.850 |
| 0.496 | 0.122 | 7.850 |
| 0.504 | 0.147 | 7.850 |
| 0.513 | 0.171 | 7.850 |
| 0.521 | 0.195 | 7.850 |
| 0.529 | 0.219 | 7.850 |
| 0.537 | 0.243 | 7.850 |
| 0.545 | 0.268 | 7.850 |
| 0.553 | 0.292 | 7.850 |
| 0.560 | 0.317 | 7.850 |
| 0.568 | 0.341 | 7.850 |
| 0.575 | 0.365 | 7.850 |
| 0.583 | 0.390 | 7.850 |
| 0.590 | 0.415 | 7.850 |
| 0.597 | 0.439 | 7.850 |
| 0.604 | 0.464 | 7.850 |
| 0.611 | 0.488 | 7.850 |
| 0.618 | 0.513 | 7.850 |
| 0.624 | 0.538 | 7.850 |
| 0.631 | 0.562 | 7.850 |
| 0.638 | 0.587 | 7.850 |
| 0.644 | 0.612 | 7.850 |
| 0.650 | 0.637 | 7.850 |
| 0.657 | 0.661 | 7.850 |
| 0.663 | 0.686 | 7.850 |
| 0.669 | 0.711 | 7.850 |
| 0.675 | 0.736 | 7.850 |
| 0.681 | 0.761 | 7.850 |
| 0.687 | 0.786 | 7.850 |
| 0.693 | 0.810 | 7.850 |
| 0.694 | 0.815 | 7.850 |
| 0.695 | 0.820 | 7.850 |
| 0.697 | 0.825 | 7.850 |
| 0.698 | 0.830 | 7.850 |
| 0.699 | 0.835 | 7.850 |
| 0.700 | 0.840 | 7.850 |
| 0.701 | 0.845 | 7.850 |
| 0.702 | 0.850 | 7.850 |
| 0.703 | 0.855 | 7.850 |
| 0.704 | 0.860 | 7.850 |
| 0.705 | 0.863 | 7.850 |
| 0.705 | 0.866 | 7.850 |
| 0.705 | 0.869 | 7.850 |
| 0.704 | 0.872 | 7.850 |
| 0.702 | 0.875 | 7.850 |
| 0.701 | 0.877 | 7.850 |
| 0.699 | 0.879 | 7.850 |
| 0.697 | 0.881 | 7.850 |
| 0.694 | 0.883 | 7.850 |
| 0.692 | 0.884 | 7.850 |
| 0.689 | 0.885 | 7.850 |
| 0.686 | 0.885 | 7.850 |
| 0.683 | 0.885 | 7.850 |
| 0.680 | 0.884 | 7.850 |
| 0.678 | 0.882 | 7.850 |
| 0.675 | 0.881 | 7.850 |
| 0.673 | 0.879 | 7.850 |
| 0.671 | 0.877 | 7.850 |
| 0.669 | 0.874 | 7.850 |
| 0.668 | 0.871 | 7.850 |
| 0.666 | 0.867 | 7.850 |
| 0.664 | 0.864 | 7.850 |
| 0.662 | 0.861 | 7.850 |
| 0.660 | 0.857 | 7.850 |
| 0.658 | 0.854 | 7.850 |
| 0.656 | 0.851 | 7.850 |
| 0.654 | 0.847 | 7.850 |
| 0.652 | 0.844 | 7.850 |

TABLE 2-continued

| X | Y | Z |
|---|---|---|
| 0.650 | 0.841 | 7.850 |
| 0.641 | 0.824 | 7.850 |
| 0.631 | 0.807 | 7.850 |
| 0.622 | 0.790 | 7.850 |
| 0.613 | 0.773 | 7.850 |
| 0.604 | 0.756 | 7.850 |
| 0.594 | 0.739 | 7.850 |
| 0.585 | 0.722 | 7.850 |
| 0.576 | 0.706 | 7.850 |
| 0.566 | 0.689 | 7.850 |
| 0.557 | 0.672 | 7.850 |
| 0.547 | 0.655 | 7.850 |
| 0.537 | 0.639 | 7.850 |
| 0.528 | 0.622 | 7.850 |
| 0.518 | 0.605 | 7.850 |
| 0.508 | 0.589 | 7.850 |
| 0.498 | 0.572 | 7.850 |
| 0.488 | 0.556 | 7.850 |
| 0.478 | 0.539 | 7.850 |
| 0.468 | 0.523 | 7.850 |
| 0.458 | 0.506 | 7.850 |
| 0.448 | 0.490 | 7.850 |
| 0.438 | 0.473 | 7.850 |
| 0.428 | 0.457 | 7.850 |
| 0.418 | 0.441 | 7.850 |
| 0.408 | 0.424 | 7.850 |
| 0.398 | 0.408 | 7.850 |
| 0.387 | 0.391 | 7.850 |
| 0.377 | 0.375 | 7.850 |
| 0.367 | 0.359 | 7.850 |
| 0.357 | 0.342 | 7.850 |
| 0.346 | 0.326 | 7.850 |
| 0.336 | 0.310 | 7.850 |
| 0.325 | 0.294 | 7.850 |
| 0.315 | 0.278 | 7.850 |
| 0.304 | 0.261 | 7.850 |
| 0.294 | 0.245 | 7.850 |
| 0.283 | 0.229 | 7.850 |
| 0.272 | 0.213 | 7.850 |
| 0.261 | 0.197 | 7.850 |
| 0.251 | 0.181 | 7.850 |
| 0.240 | 0.165 | 7.850 |
| 0.229 | 0.150 | 7.850 |
| 0.218 | 0.134 | 7.850 |
| 0.207 | 0.118 | 7.850 |
| 0.195 | 0.102 | 7.850 |
| 0.184 | 0.087 | 7.850 |
| 0.173 | 0.071 | 7.850 |
| 0.161 | 0.056 | 7.850 |
| 0.150 | 0.040 | 7.850 |
| 0.138 | 0.025 | 7.850 |
| 0.126 | 0.009 | 7.850 |
| 0.115 | −0.006 | 7.850 |
| 0.103 | −0.021 | 7.850 |
| 0.091 | −0.036 | 7.850 |
| 0.078 | −0.051 | 7.850 |
| 0.066 | −0.066 | 7.850 |
| 0.054 | −0.080 | 7.850 |
| 0.041 | −0.095 | 7.850 |
| 0.028 | −0.109 | 7.850 |
| 0.015 | −0.124 | 7.850 |
| 0.002 | −0.138 | 7.850 |
| −0.011 | −0.152 | 7.850 |
| −0.025 | −0.166 | 7.850 |
| −0.038 | −0.179 | 7.850 |
| −0.052 | −0.193 | 7.850 |
| −0.066 | −0.206 | 7.850 |
| −0.080 | −0.219 | 7.850 |
| −0.095 | −0.231 | 7.850 |
| −0.110 | −0.244 | 7.850 |
| −0.125 | −0.256 | 7.850 |
| −0.141 | −0.267 | 7.850 |
| −0.156 | −0.278 | 7.850 |
| −0.173 | −0.288 | 7.850 |
| −0.189 | −0.298 | 7.850 |
| −0.206 | −0.307 | 7.850 |
| −0.224 | −0.315 | 7.850 |
| −0.242 | −0.323 | 7.850 |

TABLE 2-continued

| X | Y | Z |
|---|---|---|
| −0.260 | −0.329 | 7.850 |
| −0.279 | −0.334 | 7.850 |
| −0.282 | −0.334 | 7.850 |
| −0.286 | −0.335 | 7.850 |
| −0.290 | −0.336 | 7.850 |
| −0.294 | −0.336 | 7.850 |
| −0.298 | −0.337 | 7.850 |
| −0.301 | −0.337 | 7.850 |
| −0.305 | −0.338 | 7.850 |
| −0.309 | −0.338 | 7.850 |
| −0.313 | −0.338 | 7.850 |
| −0.317 | −0.339 | 7.850 |
| −0.332 | −0.339 | 7.850 |
| −0.346 | −0.341 | 7.850 |
| −0.361 | −0.344 | 7.850 |
| −0.375 | −0.348 | 7.850 |
| −0.389 | −0.353 | 7.850 |
| −0.402 | −0.360 | 7.850 |
| −0.415 | −0.368 | 7.850 |
| −0.426 | −0.378 | 7.850 |
| −0.435 | −0.390 | 7.850 |
| −0.441 | −0.403 | 7.850 |
| −0.445 | −0.417 | 7.850 |
| −0.446 | −0.432 | 7.850 |
| −0.445 | −0.447 | 7.850 |
| −0.442 | −0.461 | 7.850 |
| −0.437 | −0.476 | 7.850 |
| −0.431 | −0.489 | 7.850 |
| −0.424 | −0.502 | 7.850 |
| −0.416 | −0.515 | 7.850 |
| | SECTION 11 | |
| −0.400 | −0.488 | 8.040 |
| −0.396 | −0.492 | 8.040 |
| −0.393 | −0.496 | 8.040 |
| −0.389 | −0.499 | 8.040 |
| −0.385 | −0.503 | 8.040 |
| −0.382 | −0.507 | 8.040 |
| −0.378 | −0.510 | 8.040 |
| −0.374 | −0.513 | 8.040 |
| −0.370 | −0.517 | 8.040 |
| −0.366 | −0.520 | 8.040 |
| −0.362 | −0.523 | 8.040 |
| −0.342 | −0.539 | 8.040 |
| −0.321 | −0.553 | 8.040 |
| −0.298 | −0.565 | 8.040 |
| −0.275 | −0.576 | 8.040 |
| −0.251 | −0.585 | 8.040 |
| −0.227 | −0.593 | 8.040 |
| −0.202 | −0.598 | 8.040 |
| −0.177 | −0.602 | 8.040 |
| −0.151 | −0.604 | 8.040 |
| −0.126 | −0.604 | 8.040 |
| −0.100 | −0.602 | 8.040 |
| −0.075 | −0.599 | 8.040 |
| −0.050 | −0.594 | 8.040 |
| −0.025 | −0.587 | 8.040 |
| −0.001 | −0.578 | 8.040 |
| 0.022 | −0.568 | 8.040 |
| 0.045 | −0.557 | 8.040 |
| 0.068 | −0.544 | 8.040 |
| 0.089 | −0.530 | 8.040 |
| 0.110 | −0.516 | 8.040 |
| 0.130 | −0.500 | 8.040 |
| 0.149 | −0.483 | 8.040 |
| 0.168 | −0.466 | 8.040 |
| 0.186 | −0.448 | 8.040 |
| 0.204 | −0.429 | 8.040 |
| 0.221 | −0.410 | 8.040 |
| 0.237 | −0.391 | 8.040 |
| 0.253 | −0.371 | 8.040 |
| 0.269 | −0.350 | 8.040 |
| 0.283 | −0.329 | 8.040 |
| 0.298 | −0.308 | 8.040 |
| 0.312 | −0.287 | 8.040 |
| 0.325 | −0.265 | 8.040 |
| 0.338 | −0.243 | 8.040 |
| 0.351 | −0.221 | 8.040 |

TABLE 2-continued

| X | Y | Z |
|---|---|---|
| 0.363 | −0.199 | 8.040 |
| 0.375 | −0.176 | 8.040 |
| 0.387 | −0.153 | 8.040 |
| 0.399 | −0.130 | 8.040 |
| 0.410 | −0.107 | 8.040 |
| 0.420 | −0.084 | 8.040 |
| 0.431 | −0.061 | 8.040 |
| 0.441 | −0.038 | 8.040 |
| 0.451 | −0.014 | 8.040 |
| 0.461 | 0.010 | 8.040 |
| 0.471 | 0.033 | 8.040 |
| 0.480 | 0.057 | 8.040 |
| 0.489 | 0.081 | 8.040 |
| 0.498 | 0.105 | 8.040 |
| 0.507 | 0.129 | 8.040 |
| 0.515 | 0.153 | 8.040 |
| 0.524 | 0.177 | 8.040 |
| 0.532 | 0.201 | 8.040 |
| 0.540 | 0.226 | 8.040 |
| 0.548 | 0.250 | 8.040 |
| 0.555 | 0.274 | 8.040 |
| 0.563 | 0.299 | 8.040 |
| 0.571 | 0.323 | 8.040 |
| 0.578 | 0.348 | 8.040 |
| 0.585 | 0.372 | 8.040 |
| 0.592 | 0.397 | 8.040 |
| 0.599 | 0.421 | 8.040 |
| 0.606 | 0.446 | 8.040 |
| 0.612 | 0.471 | 8.040 |
| 0.619 | 0.495 | 8.040 |
| 0.625 | 0.520 | 8.040 |
| 0.632 | 0.545 | 8.040 |
| 0.638 | 0.570 | 8.040 |
| 0.644 | 0.595 | 8.040 |
| 0.650 | 0.620 | 8.040 |
| 0.655 | 0.644 | 8.040 |
| 0.661 | 0.669 | 8.040 |
| 0.667 | 0.694 | 8.040 |
| 0.672 | 0.719 | 8.040 |
| 0.678 | 0.744 | 8.040 |
| 0.683 | 0.769 | 8.040 |
| 0.688 | 0.794 | 8.040 |
| 0.693 | 0.819 | 8.040 |
| 0.698 | 0.844 | 8.040 |
| 0.699 | 0.849 | 8.040 |
| 0.700 | 0.854 | 8.040 |
| 0.701 | 0.859 | 8.040 |
| 0.702 | 0.864 | 8.040 |
| 0.703 | 0.869 | 8.040 |
| 0.704 | 0.874 | 8.040 |
| 0.705 | 0.880 | 8.040 |
| 0.706 | 0.885 | 8.040 |
| 0.707 | 0.890 | 8.040 |
| 0.708 | 0.895 | 8.040 |
| 0.708 | 0.898 | 8.040 |
| 0.708 | 0.900 | 8.040 |
| 0.707 | 0.903 | 8.040 |
| 0.706 | 0.906 | 8.040 |
| 0.705 | 0.909 | 8.040 |
| 0.703 | 0.911 | 8.040 |
| 0.701 | 0.913 | 8.040 |
| 0.699 | 0.915 | 8.040 |
| 0.696 | 0.917 | 8.040 |
| 0.694 | 0.918 | 8.040 |
| 0.691 | 0.918 | 8.040 |
| 0.688 | 0.918 | 8.040 |
| 0.685 | 0.918 | 8.040 |
| 0.682 | 0.917 | 8.040 |
| 0.680 | 0.916 | 8.040 |
| 0.677 | 0.914 | 8.040 |
| 0.675 | 0.912 | 8.040 |
| 0.674 | 0.909 | 8.040 |
| 0.672 | 0.907 | 8.040 |
| 0.670 | 0.904 | 8.040 |
| 0.669 | 0.900 | 8.040 |
| 0.667 | 0.897 | 8.040 |
| 0.665 | 0.893 | 8.040 |
| 0.663 | 0.890 | 8.040 |

TABLE 2-continued

| X | Y | Z |
|---|---|---|
| 0.661 | 0.886 | 8.040 |
| 0.660 | 0.883 | 8.040 |
| 0.658 | 0.880 | 8.040 |
| 0.656 | 0.876 | 8.040 |
| 0.654 | 0.873 | 8.040 |
| 0.645 | 0.856 | 8.040 |
| 0.636 | 0.839 | 8.040 |
| 0.628 | 0.821 | 8.040 |
| 0.619 | 0.804 | 8.040 |
| 0.610 | 0.787 | 8.040 |
| 0.602 | 0.770 | 8.040 |
| 0.593 | 0.753 | 8.040 |
| 0.584 | 0.736 | 8.040 |
| 0.575 | 0.719 | 8.040 |
| 0.566 | 0.702 | 8.040 |
| 0.556 | 0.685 | 8.040 |
| 0.547 | 0.668 | 8.040 |
| 0.538 | 0.651 | 8.040 |
| 0.528 | 0.634 | 8.040 |
| 0.519 | 0.617 | 8.040 |
| 0.509 | 0.601 | 8.040 |
| 0.499 | 0.584 | 8.040 |
| 0.490 | 0.567 | 8.040 |
| 0.480 | 0.551 | 8.040 |
| 0.470 | 0.534 | 8.040 |
| 0.460 | 0.518 | 8.040 |
| 0.451 | 0.501 | 8.040 |
| 0.441 | 0.484 | 8.040 |
| 0.431 | 0.468 | 8.040 |
| 0.421 | 0.451 | 8.040 |
| 0.411 | 0.435 | 8.040 |
| 0.401 | 0.419 | 8.040 |
| 0.391 | 0.402 | 8.040 |
| 0.380 | 0.386 | 8.040 |
| 0.370 | 0.369 | 8.040 |
| 0.360 | 0.353 | 8.040 |
| 0.349 | 0.337 | 8.040 |
| 0.339 | 0.321 | 8.040 |
| 0.328 | 0.305 | 8.040 |
| 0.318 | 0.289 | 8.040 |
| 0.307 | 0.273 | 8.040 |
| 0.296 | 0.257 | 8.040 |
| 0.285 | 0.241 | 8.040 |
| 0.275 | 0.225 | 8.040 |
| 0.264 | 0.209 | 8.040 |
| 0.252 | 0.193 | 8.040 |
| 0.241 | 0.177 | 8.040 |
| 0.230 | 0.162 | 8.040 |
| 0.219 | 0.146 | 8.040 |
| 0.207 | 0.131 | 8.040 |
| 0.196 | 0.115 | 8.040 |
| 0.184 | 0.100 | 8.040 |
| 0.172 | 0.085 | 8.040 |
| 0.160 | 0.069 | 8.040 |
| 0.148 | 0.054 | 8.040 |
| 0.136 | 0.039 | 8.040 |
| 0.124 | 0.025 | 8.040 |
| 0.112 | 0.010 | 8.040 |
| 0.099 | −0.005 | 8.040 |
| 0.086 | −0.019 | 8.040 |
| 0.073 | −0.034 | 8.040 |
| 0.060 | −0.048 | 8.040 |
| 0.047 | −0.062 | 8.040 |
| 0.034 | −0.076 | 8.040 |
| 0.020 | −0.090 | 8.040 |
| 0.007 | −0.103 | 8.040 |
| −0.007 | −0.116 | 8.040 |
| −0.021 | −0.130 | 8.040 |
| −0.036 | −0.143 | 8.040 |
| −0.050 | −0.155 | 8.040 |
| −0.065 | −0.168 | 8.040 |
| −0.080 | −0.180 | 8.040 |
| −0.095 | −0.191 | 8.040 |
| −0.111 | −0.203 | 8.040 |
| −0.127 | −0.214 | 8.040 |
| −0.143 | −0.224 | 8.040 |
| −0.159 | −0.235 | 8.040 |
| −0.176 | −0.244 | 8.040 |

TABLE 2-continued

| X | Y | Z |
|---|---|---|
| −0.193 | −0.253 | 8.040 |
| −0.210 | −0.262 | 8.040 |
| −0.228 | −0.270 | 8.040 |
| −0.246 | −0.277 | 8.040 |
| −0.264 | −0.283 | 8.040 |
| −0.283 | −0.288 | 8.040 |
| −0.286 | −0.289 | 8.040 |
| −0.290 | −0.290 | 8.040 |
| −0.294 | −0.291 | 8.040 |
| −0.298 | −0.291 | 8.040 |
| −0.301 | −0.292 | 8.040 |
| −0.305 | −0.293 | 8.040 |
| −0.309 | −0.294 | 8.040 |
| −0.313 | −0.294 | 8.040 |
| −0.317 | −0.295 | 8.040 |
| −0.320 | −0.295 | 8.040 |
| −0.335 | −0.297 | 8.040 |
| −0.350 | −0.300 | 8.040 |
| −0.364 | −0.304 | 8.040 |
| −0.378 | −0.309 | 8.040 |
| −0.392 | −0.315 | 8.040 |
| −0.405 | −0.323 | 8.040 |
| −0.417 | −0.332 | 8.040 |
| −0.427 | −0.342 | 8.040 |
| −0.436 | −0.354 | 8.040 |
| −0.442 | −0.368 | 8.040 |
| −0.445 | −0.382 | 8.040 |
| −0.446 | −0.397 | 8.040 |
| −0.444 | −0.412 | 8.040 |
| −0.440 | −0.426 | 8.040 |
| −0.434 | −0.440 | 8.040 |
| −0.427 | −0.453 | 8.040 |
| −0.419 | −0.466 | 8.040 |
| −0.410 | −0.477 | 8.040 |
| SECTION 12 | | |
| −0.382 | −0.440 | 8.270 |
| −0.378 | −0.443 | 8.270 |
| −0.373 | −0.446 | 8.270 |
| −0.369 | −0.448 | 8.270 |
| −0.365 | −0.451 | 8.270 |
| −0.361 | −0.454 | 8.270 |
| −0.357 | −0.457 | 8.270 |
| −0.352 | −0.459 | 8.270 |
| −0.348 | −0.462 | 8.270 |
| −0.344 | −0.465 | 8.270 |
| −0.339 | −0.467 | 8.270 |
| −0.317 | −0.480 | 8.270 |
| −0.295 | −0.491 | 8.270 |
| −0.271 | −0.501 | 8.270 |
| −0.248 | −0.510 | 8.270 |
| −0.223 | −0.518 | 8.270 |
| −0.199 | −0.524 | 8.270 |
| −0.174 | −0.529 | 8.270 |
| −0.149 | −0.533 | 8.270 |
| −0.124 | −0.535 | 8.270 |
| −0.098 | −0.536 | 8.270 |
| −0.073 | −0.536 | 8.270 |
| −0.048 | −0.534 | 8.270 |
| −0.022 | −0.531 | 8.270 |
| 0.002 | −0.526 | 8.270 |
| 0.027 | −0.519 | 8.270 |
| 0.051 | −0.512 | 8.270 |
| 0.075 | −0.502 | 8.270 |
| 0.098 | −0.492 | 8.270 |
| 0.120 | −0.480 | 8.270 |
| 0.142 | −0.467 | 8.270 |
| 0.163 | −0.453 | 8.270 |
| 0.184 | −0.438 | 8.270 |
| 0.204 | −0.422 | 8.270 |
| 0.223 | −0.406 | 8.270 |
| 0.241 | −0.388 | 8.270 |
| 0.259 | −0.370 | 8.270 |
| 0.276 | −0.351 | 8.270 |
| 0.292 | −0.332 | 8.270 |
| 0.308 | −0.312 | 8.270 |
| 0.323 | −0.292 | 8.270 |
| 0.338 | −0.271 | 8.270 |

TABLE 2-continued

| X | Y | Z |
|---|---|---|
| 0.352 | −0.250 | 8.270 |
| 0.366 | −0.229 | 8.270 |
| 0.379 | −0.207 | 8.270 |
| 0.392 | −0.185 | 8.270 |
| 0.404 | −0.163 | 8.270 |
| 0.416 | −0.140 | 8.270 |
| 0.427 | −0.118 | 8.270 |
| 0.438 | −0.095 | 8.270 |
| 0.449 | −0.072 | 8.270 |
| 0.460 | −0.049 | 8.270 |
| 0.470 | −0.026 | 8.270 |
| 0.480 | −0.002 | 8.270 |
| 0.490 | 0.021 | 8.270 |
| 0.499 | 0.045 | 8.270 |
| 0.508 | 0.068 | 8.270 |
| 0.517 | 0.092 | 8.270 |
| 0.525 | 0.116 | 8.270 |
| 0.534 | 0.140 | 8.270 |
| 0.542 | 0.164 | 8.270 |
| 0.550 | 0.188 | 8.270 |
| 0.557 | 0.212 | 8.270 |
| 0.565 | 0.237 | 8.270 |
| 0.572 | 0.261 | 8.270 |
| 0.579 | 0.285 | 8.270 |
| 0.586 | 0.310 | 8.270 |
| 0.593 | 0.334 | 8.270 |
| 0.599 | 0.359 | 8.270 |
| 0.606 | 0.383 | 8.270 |
| 0.612 | 0.408 | 8.270 |
| 0.618 | 0.433 | 8.270 |
| 0.624 | 0.457 | 8.270 |
| 0.629 | 0.482 | 8.270 |
| 0.635 | 0.507 | 8.270 |
| 0.640 | 0.532 | 8.270 |
| 0.645 | 0.556 | 8.270 |
| 0.650 | 0.581 | 8.270 |
| 0.655 | 0.606 | 8.270 |
| 0.660 | 0.631 | 8.270 |
| 0.664 | 0.656 | 8.270 |
| 0.669 | 0.681 | 8.270 |
| 0.673 | 0.706 | 8.270 |
| 0.677 | 0.731 | 8.270 |
| 0.682 | 0.756 | 8.270 |
| 0.685 | 0.781 | 8.270 |
| 0.689 | 0.806 | 8.270 |
| 0.693 | 0.831 | 8.270 |
| 0.696 | 0.856 | 8.270 |
| 0.700 | 0.882 | 8.270 |
| 0.700 | 0.887 | 8.270 |
| 0.701 | 0.892 | 8.270 |
| 0.702 | 0.897 | 8.270 |
| 0.702 | 0.902 | 8.270 |
| 0.703 | 0.907 | 8.270 |
| 0.703 | 0.912 | 8.270 |
| 0.704 | 0.917 | 8.270 |
| 0.705 | 0.922 | 8.270 |
| 0.705 | 0.927 | 8.270 |
| 0.706 | 0.932 | 8.270 |
| 0.706 | 0.935 | 8.270 |
| 0.706 | 0.938 | 8.270 |
| 0.705 | 0.941 | 8.270 |
| 0.704 | 0.943 | 8.270 |
| 0.702 | 0.946 | 8.270 |
| 0.700 | 0.948 | 8.270 |
| 0.698 | 0.950 | 8.270 |
| 0.696 | 0.952 | 8.270 |
| 0.693 | 0.953 | 8.270 |
| 0.690 | 0.954 | 8.270 |
| 0.688 | 0.955 | 8.270 |
| 0.685 | 0.954 | 8.270 |
| 0.682 | 0.954 | 8.270 |
| 0.679 | 0.953 | 8.270 |
| 0.677 | 0.951 | 8.270 |
| 0.674 | 0.949 | 8.270 |
| 0.672 | 0.947 | 8.270 |
| 0.671 | 0.945 | 8.270 |
| 0.669 | 0.942 | 8.270 |
| 0.668 | 0.938 | 8.270 |

TABLE 2-continued

| X | Y | Z |
|---|---|---|
| 0.666 | 0.935 | 8.270 |
| 0.665 | 0.931 | 8.270 |
| 0.663 | 0.928 | 8.270 |
| 0.662 | 0.924 | 8.270 |
| 0.660 | 0.921 | 8.270 |
| 0.659 | 0.917 | 8.270 |
| 0.657 | 0.914 | 8.270 |
| 0.656 | 0.910 | 8.270 |
| 0.654 | 0.907 | 8.270 |
| 0.646 | 0.889 | 8.270 |
| 0.638 | 0.872 | 8.270 |
| 0.631 | 0.854 | 8.270 |
| 0.623 | 0.836 | 8.270 |
| 0.616 | 0.819 | 8.270 |
| 0.608 | 0.801 | 8.270 |
| 0.600 | 0.783 | 8.270 |
| 0.592 | 0.766 | 8.270 |
| 0.584 | 0.748 | 8.270 |
| 0.575 | 0.731 | 8.270 |
| 0.567 | 0.714 | 8.270 |
| 0.558 | 0.696 | 8.270 |
| 0.550 | 0.679 | 8.270 |
| 0.541 | 0.662 | 8.270 |
| 0.532 | 0.645 | 8.270 |
| 0.523 | 0.628 | 8.270 |
| 0.514 | 0.611 | 8.270 |
| 0.505 | 0.594 | 8.270 |
| 0.496 | 0.577 | 8.270 |
| 0.486 | 0.560 | 8.270 |
| 0.477 | 0.543 | 8.270 |
| 0.468 | 0.527 | 8.270 |
| 0.458 | 0.510 | 8.270 |
| 0.449 | 0.493 | 8.270 |
| 0.439 | 0.477 | 8.270 |
| 0.429 | 0.460 | 8.270 |
| 0.419 | 0.443 | 8.270 |
| 0.410 | 0.427 | 8.270 |
| 0.400 | 0.410 | 8.270 |
| 0.389 | 0.394 | 8.270 |
| 0.379 | 0.378 | 8.270 |
| 0.369 | 0.362 | 8.270 |
| 0.358 | 0.345 | 8.270 |
| 0.348 | 0.329 | 8.270 |
| 0.337 | 0.313 | 8.270 |
| 0.326 | 0.297 | 8.270 |
| 0.315 | 0.281 | 8.270 |
| 0.304 | 0.266 | 8.270 |
| 0.293 | 0.250 | 8.270 |
| 0.282 | 0.234 | 8.270 |
| 0.271 | 0.219 | 8.270 |
| 0.259 | 0.203 | 8.270 |
| 0.247 | 0.188 | 8.270 |
| 0.235 | 0.173 | 8.270 |
| 0.223 | 0.158 | 8.270 |
| 0.211 | 0.143 | 8.270 |
| 0.199 | 0.128 | 8.270 |
| 0.186 | 0.114 | 8.270 |
| 0.174 | 0.099 | 8.270 |
| 0.161 | 0.085 | 8.270 |
| 0.148 | 0.070 | 8.270 |
| 0.135 | 0.056 | 8.270 |
| 0.121 | 0.043 | 8.270 |
| 0.108 | 0.029 | 8.270 |
| 0.094 | 0.015 | 8.270 |
| 0.080 | 0.002 | 8.270 |
| 0.066 | −0.011 | 8.270 |
| 0.052 | −0.024 | 8.270 |
| 0.037 | −0.036 | 8.270 |
| 0.022 | −0.049 | 8.270 |
| 0.007 | −0.061 | 8.270 |
| −0.008 | −0.072 | 8.270 |
| −0.023 | −0.084 | 8.270 |
| −0.039 | −0.095 | 8.270 |
| −0.055 | −0.106 | 8.270 |
| −0.071 | −0.116 | 8.270 |
| −0.088 | −0.126 | 8.270 |
| −0.104 | −0.136 | 8.270 |
| −0.121 | −0.145 | 8.270 |

TABLE 2-continued

| X | Y | Z |
|---|---|---|
| −0.138 | −0.154 | 8.270 |
| −0.155 | −0.163 | 8.270 |
| −0.173 | −0.171 | 8.270 |
| −0.191 | −0.178 | 8.270 |
| −0.208 | −0.186 | 8.270 |
| −0.226 | −0.193 | 8.270 |
| −0.244 | −0.199 | 8.270 |
| −0.263 | −0.206 | 8.270 |
| −0.281 | −0.212 | 8.270 |
| −0.299 | −0.217 | 8.270 |
| −0.303 | −0.219 | 8.270 |
| −0.307 | −0.220 | 8.270 |
| −0.310 | −0.221 | 8.270 |
| −0.314 | −0.222 | 8.270 |
| −0.318 | −0.223 | 8.270 |
| −0.321 | −0.224 | 8.270 |
| −0.325 | −0.225 | 8.270 |
| −0.329 | −0.227 | 8.270 |
| −0.332 | −0.228 | 8.270 |
| −0.336 | −0.229 | 8.270 |
| −0.351 | −0.234 | 8.270 |
| −0.365 | −0.240 | 8.270 |
| −0.379 | −0.246 | 8.270 |
| −0.392 | −0.254 | 8.270 |
| −0.405 | −0.262 | 8.270 |
| −0.417 | −0.272 | 8.270 |
| −0.427 | −0.284 | 8.270 |
| −0.436 | −0.296 | 8.270 |
| −0.443 | −0.310 | 8.270 |
| −0.447 | −0.325 | 8.270 |
| −0.448 | −0.340 | 8.270 |
| −0.446 | −0.356 | 8.270 |
| −0.442 | −0.370 | 8.270 |
| −0.435 | −0.384 | 8.270 |
| −0.426 | −0.397 | 8.270 |
| −0.416 | −0.409 | 8.270 |
| −0.406 | −0.420 | 8.270 |
| −0.394 | −0.430 | 8.270 |
| | SECTION 13 | |
| −0.363 | −0.389 | 8.500 |
| −0.359 | −0.391 | 8.500 |
| −0.354 | −0.393 | 8.500 |
| −0.350 | −0.395 | 8.500 |
| −0.345 | −0.397 | 8.500 |
| −0.340 | −0.399 | 8.500 |
| −0.336 | −0.401 | 8.500 |
| −0.331 | −0.403 | 8.500 |
| −0.326 | −0.405 | 8.500 |
| −0.322 | −0.407 | 8.500 |
| −0.317 | −0.409 | 8.500 |
| −0.293 | −0.417 | 8.500 |
| −0.269 | −0.426 | 8.500 |
| −0.245 | −0.433 | 8.500 |
| −0.221 | −0.440 | 8.500 |
| −0.196 | −0.446 | 8.500 |
| −0.171 | −0.451 | 8.500 |
| −0.147 | −0.455 | 8.500 |
| −0.122 | −0.459 | 8.500 |
| −0.096 | −0.462 | 8.500 |
| −0.071 | −0.464 | 8.500 |
| −0.046 | −0.464 | 8.500 |
| −0.021 | −0.464 | 8.500 |
| 0.005 | −0.463 | 8.500 |
| 0.030 | −0.460 | 8.500 |
| 0.055 | −0.456 | 8.500 |
| 0.079 | −0.451 | 8.500 |
| 0.104 | −0.444 | 8.500 |
| 0.128 | −0.437 | 8.500 |
| 0.151 | −0.427 | 8.500 |
| 0.174 | −0.417 | 8.500 |
| 0.197 | −0.405 | 8.500 |
| 0.219 | −0.392 | 8.500 |
| 0.240 | −0.379 | 8.500 |
| 0.260 | −0.364 | 8.500 |
| 0.280 | −0.348 | 8.500 |
| 0.298 | −0.331 | 8.500 |
| 0.316 | −0.313 | 8.500 |

TABLE 2-continued

| X | Y | Z |
|---|---|---|
| 0.334 | −0.295 | 8.500 |
| 0.350 | −0.276 | 8.500 |
| 0.366 | −0.256 | 8.500 |
| 0.382 | −0.236 | 8.500 |
| 0.396 | −0.215 | 8.500 |
| 0.410 | −0.194 | 8.500 |
| 0.423 | −0.173 | 8.500 |
| 0.436 | −0.151 | 8.500 |
| 0.449 | −0.129 | 8.500 |
| 0.461 | −0.107 | 8.500 |
| 0.472 | −0.084 | 8.500 |
| 0.483 | −0.061 | 8.500 |
| 0.494 | −0.038 | 8.500 |
| 0.504 | −0.015 | 8.500 |
| 0.514 | 0.008 | 8.500 |
| 0.524 | 0.031 | 8.500 |
| 0.533 | 0.055 | 8.500 |
| 0.542 | 0.078 | 8.500 |
| 0.550 | 0.102 | 8.500 |
| 0.559 | 0.126 | 8.500 |
| 0.567 | 0.150 | 8.500 |
| 0.574 | 0.174 | 8.500 |
| 0.581 | 0.199 | 8.500 |
| 0.588 | 0.223 | 8.500 |
| 0.595 | 0.247 | 8.500 |
| 0.602 | 0.272 | 8.500 |
| 0.608 | 0.296 | 8.500 |
| 0.614 | 0.321 | 8.500 |
| 0.620 | 0.345 | 8.500 |
| 0.626 | 0.370 | 8.500 |
| 0.631 | 0.395 | 8.500 |
| 0.636 | 0.419 | 8.500 |
| 0.641 | 0.444 | 8.500 |
| 0.646 | 0.469 | 8.500 |
| 0.650 | 0.494 | 8.500 |
| 0.655 | 0.519 | 8.500 |
| 0.659 | 0.544 | 8.500 |
| 0.663 | 0.569 | 8.500 |
| 0.667 | 0.594 | 8.500 |
| 0.670 | 0.619 | 8.500 |
| 0.674 | 0.644 | 8.500 |
| 0.677 | 0.669 | 8.500 |
| 0.680 | 0.694 | 8.500 |
| 0.683 | 0.719 | 8.500 |
| 0.685 | 0.744 | 8.500 |
| 0.688 | 0.769 | 8.500 |
| 0.690 | 0.794 | 8.500 |
| 0.692 | 0.820 | 8.500 |
| 0.695 | 0.845 | 8.500 |
| 0.696 | 0.870 | 8.500 |
| 0.698 | 0.895 | 8.500 |
| 0.700 | 0.920 | 8.500 |
| 0.700 | 0.925 | 8.500 |
| 0.700 | 0.930 | 8.500 |
| 0.700 | 0.935 | 8.500 |
| 0.701 | 0.941 | 8.500 |
| 0.701 | 0.946 | 8.500 |
| 0.701 | 0.951 | 8.500 |
| 0.701 | 0.956 | 8.500 |
| 0.702 | 0.961 | 8.500 |
| 0.702 | 0.966 | 8.500 |
| 0.702 | 0.971 | 8.500 |
| 0.702 | 0.974 | 8.500 |
| 0.701 | 0.977 | 8.500 |
| 0.700 | 0.980 | 8.500 |
| 0.699 | 0.982 | 8.500 |
| 0.697 | 0.985 | 8.500 |
| 0.695 | 0.987 | 8.500 |
| 0.693 | 0.989 | 8.500 |
| 0.691 | 0.990 | 8.500 |
| 0.688 | 0.991 | 8.500 |
| 0.685 | 0.992 | 8.500 |
| 0.682 | 0.992 | 8.500 |
| 0.679 | 0.992 | 8.500 |
| 0.676 | 0.991 | 8.500 |
| 0.674 | 0.990 | 8.500 |
| 0.671 | 0.988 | 8.500 |
| 0.669 | 0.986 | 8.500 |

TABLE 2-continued

| X | Y | Z |
|---|---|---|
| 0.667 | 0.984 | 8.500 |
| 0.666 | 0.981 | 8.500 |
| 0.665 | 0.978 | 8.500 |
| 0.664 | 0.975 | 8.500 |
| 0.662 | 0.971 | 8.500 |
| 0.661 | 0.967 | 8.500 |
| 0.660 | 0.964 | 8.500 |
| 0.659 | 0.960 | 8.500 |
| 0.657 | 0.956 | 8.500 |
| 0.656 | 0.953 | 8.500 |
| 0.655 | 0.949 | 8.500 |
| 0.654 | 0.945 | 8.500 |
| 0.652 | 0.942 | 8.500 |
| 0.646 | 0.924 | 8.500 |
| 0.639 | 0.905 | 8.500 |
| 0.632 | 0.887 | 8.500 |
| 0.626 | 0.869 | 8.500 |
| 0.620 | 0.851 | 8.500 |
| 0.613 | 0.833 | 8.500 |
| 0.606 | 0.815 | 8.500 |
| 0.599 | 0.797 | 8.500 |
| 0.592 | 0.779 | 8.500 |
| 0.585 | 0.761 | 8.500 |
| 0.577 | 0.743 | 8.500 |
| 0.569 | 0.725 | 8.500 |
| 0.562 | 0.708 | 8.500 |
| 0.554 | 0.690 | 8.500 |
| 0.546 | 0.673 | 8.500 |
| 0.537 | 0.655 | 8.500 |
| 0.529 | 0.638 | 8.500 |
| 0.520 | 0.620 | 8.500 |
| 0.512 | 0.603 | 8.500 |
| 0.503 | 0.586 | 8.500 |
| 0.495 | 0.569 | 8.500 |
| 0.486 | 0.551 | 8.500 |
| 0.477 | 0.534 | 8.500 |
| 0.468 | 0.517 | 8.500 |
| 0.458 | 0.500 | 8.500 |
| 0.449 | 0.483 | 8.500 |
| 0.439 | 0.467 | 8.500 |
| 0.430 | 0.450 | 8.500 |
| 0.420 | 0.433 | 8.500 |
| 0.410 | 0.417 | 8.500 |
| 0.400 | 0.400 | 8.500 |
| 0.389 | 0.384 | 8.500 |
| 0.379 | 0.368 | 8.500 |
| 0.368 | 0.352 | 8.500 |
| 0.357 | 0.336 | 8.500 |
| 0.346 | 0.320 | 8.500 |
| 0.335 | 0.304 | 8.500 |
| 0.324 | 0.288 | 8.500 |
| 0.312 | 0.273 | 8.500 |
| 0.301 | 0.258 | 8.500 |
| 0.289 | 0.242 | 8.500 |
| 0.276 | 0.227 | 8.500 |
| 0.264 | 0.213 | 8.500 |
| 0.252 | 0.198 | 8.500 |
| 0.239 | 0.183 | 8.500 |
| 0.226 | 0.169 | 8.500 |
| 0.213 | 0.155 | 8.500 |
| 0.199 | 0.141 | 8.500 |
| 0.186 | 0.127 | 8.500 |
| 0.172 | 0.114 | 8.500 |
| 0.158 | 0.100 | 8.500 |
| 0.144 | 0.087 | 8.500 |
| 0.129 | 0.075 | 8.500 |
| 0.115 | 0.062 | 8.500 |
| 0.100 | 0.050 | 8.500 |
| 0.084 | 0.038 | 8.500 |
| 0.069 | 0.026 | 8.500 |
| 0.053 | 0.015 | 8.500 |
| 0.037 | 0.004 | 8.500 |
| 0.021 | −0.006 | 8.500 |
| 0.005 | −0.017 | 8.500 |
| −0.012 | −0.026 | 8.500 |
| −0.029 | −0.036 | 8.500 |
| −0.046 | −0.045 | 8.500 |
| −0.063 | −0.054 | 8.500 |

TABLE 2-continued

| X | Y | Z |
|---|---|---|
| −0.080 | −0.062 | 8.500 |
| −0.098 | −0.070 | 8.500 |
| −0.116 | −0.077 | 8.500 |
| −0.134 | −0.084 | 8.500 |
| −0.152 | −0.090 | 8.500 |
| −0.170 | −0.097 | 8.500 |
| −0.189 | −0.103 | 8.500 |
| −0.207 | −0.108 | 8.500 |
| −0.226 | −0.114 | 8.500 |
| −0.244 | −0.119 | 8.500 |
| −0.263 | −0.124 | 8.500 |
| −0.281 | −0.130 | 8.500 |
| −0.300 | −0.136 | 8.500 |
| −0.318 | −0.143 | 8.500 |
| −0.321 | −0.144 | 8.500 |
| −0.325 | −0.146 | 8.500 |
| −0.329 | −0.147 | 8.500 |
| −0.332 | −0.149 | 8.500 |
| −0.336 | −0.150 | 8.500 |
| −0.339 | −0.152 | 8.500 |
| −0.343 | −0.154 | 8.500 |
| −0.346 | −0.155 | 8.500 |
| −0.350 | −0.157 | 8.500 |
| −0.353 | −0.159 | 8.500 |
| −0.367 | −0.167 | 8.500 |
| −0.381 | −0.176 | 8.500 |
| −0.395 | −0.185 | 8.500 |
| −0.408 | −0.196 | 8.500 |
| −0.420 | −0.207 | 8.500 |
| −0.430 | −0.220 | 8.500 |
| −0.440 | −0.233 | 8.500 |
| −0.447 | −0.248 | 8.500 |
| −0.452 | −0.264 | 8.500 |
| −0.454 | −0.280 | 8.500 |
| −0.452 | −0.297 | 8.500 |
| −0.447 | −0.313 | 8.500 |
| −0.440 | −0.327 | 8.500 |
| −0.430 | −0.341 | 8.500 |
| −0.419 | −0.353 | 8.500 |
| −0.406 | −0.363 | 8.500 |
| −0.392 | −0.373 | 8.500 |
| −0.378 | −0.381 | 8.500 |
| SECTION 14 | | |
| −0.344 | −0.335 | 8.730 |
| −0.339 | −0.337 | 8.730 |
| −0.334 | −0.338 | 8.730 |
| −0.329 | −0.339 | 8.730 |
| −0.324 | −0.341 | 8.730 |
| −0.319 | −0.342 | 8.730 |
| −0.314 | −0.343 | 8.730 |
| −0.309 | −0.344 | 8.730 |
| −0.304 | −0.345 | 8.730 |
| −0.300 | −0.346 | 8.730 |
| −0.295 | −0.348 | 8.730 |
| −0.270 | −0.353 | 8.730 |
| −0.245 | −0.357 | 8.730 |
| −0.220 | −0.362 | 8.730 |
| −0.195 | −0.366 | 8.730 |
| −0.170 | −0.370 | 8.730 |
| −0.145 | −0.374 | 8.730 |
| −0.120 | −0.377 | 8.730 |
| −0.095 | −0.380 | 8.730 |
| −0.070 | −0.383 | 8.730 |
| −0.045 | −0.386 | 8.730 |
| −0.019 | −0.388 | 8.730 |
| 0.006 | −0.389 | 8.730 |
| 0.031 | −0.390 | 8.730 |
| 0.056 | −0.390 | 8.730 |
| 0.082 | −0.389 | 8.730 |
| 0.107 | −0.386 | 8.730 |
| 0.132 | −0.383 | 8.730 |
| 0.157 | −0.378 | 8.730 |
| 0.181 | −0.372 | 8.730 |
| 0.205 | −0.364 | 8.730 |
| 0.229 | −0.355 | 8.730 |
| 0.252 | −0.345 | 8.730 |
| 0.275 | −0.334 | 8.730 |

TABLE 2-continued

| X | Y | Z |
|---|---|---|
| 0.297 | −0.321 | 8.730 |
| 0.318 | −0.307 | 8.730 |
| 0.338 | −0.292 | 8.730 |
| 0.357 | −0.275 | 8.730 |
| 0.376 | −0.258 | 8.730 |
| 0.394 | −0.240 | 8.730 |
| 0.411 | −0.221 | 8.730 |
| 0.427 | −0.202 | 8.730 |
| 0.442 | −0.182 | 8.730 |
| 0.457 | −0.161 | 8.730 |
| 0.471 | −0.140 | 8.730 |
| 0.484 | −0.119 | 8.730 |
| 0.497 | −0.097 | 8.730 |
| 0.509 | −0.075 | 8.730 |
| 0.520 | −0.052 | 8.730 |
| 0.532 | −0.029 | 8.730 |
| 0.542 | −0.006 | 8.730 |
| 0.552 | 0.017 | 8.730 |
| 0.562 | 0.040 | 8.730 |
| 0.571 | 0.064 | 8.730 |
| 0.580 | 0.087 | 8.730 |
| 0.589 | 0.111 | 8.730 |
| 0.596 | 0.135 | 8.730 |
| 0.604 | 0.159 | 8.730 |
| 0.611 | 0.184 | 8.730 |
| 0.618 | 0.208 | 8.730 |
| 0.624 | 0.233 | 8.730 |
| 0.630 | 0.257 | 8.730 |
| 0.636 | 0.282 | 8.730 |
| 0.642 | 0.306 | 8.730 |
| 0.647 | 0.331 | 8.730 |
| 0.652 | 0.356 | 8.730 |
| 0.656 | 0.381 | 8.730 |
| 0.661 | 0.406 | 8.730 |
| 0.665 | 0.431 | 8.730 |
| 0.669 | 0.456 | 8.730 |
| 0.672 | 0.481 | 8.730 |
| 0.675 | 0.506 | 8.730 |
| 0.678 | 0.531 | 8.730 |
| 0.681 | 0.556 | 8.730 |
| 0.684 | 0.581 | 8.730 |
| 0.686 | 0.607 | 8.730 |
| 0.688 | 0.632 | 8.730 |
| 0.690 | 0.657 | 8.730 |
| 0.692 | 0.682 | 8.730 |
| 0.693 | 0.707 | 8.730 |
| 0.695 | 0.733 | 8.730 |
| 0.696 | 0.758 | 8.730 |
| 0.697 | 0.783 | 8.730 |
| 0.697 | 0.809 | 8.730 |
| 0.698 | 0.834 | 8.730 |
| 0.698 | 0.859 | 8.730 |
| 0.698 | 0.884 | 8.730 |
| 0.698 | 0.910 | 8.730 |
| 0.698 | 0.935 | 8.730 |
| 0.698 | 0.960 | 8.730 |
| 0.698 | 0.965 | 8.730 |
| 0.697 | 0.970 | 8.730 |
| 0.697 | 0.976 | 8.730 |
| 0.697 | 0.981 | 8.730 |
| 0.697 | 0.986 | 8.730 |
| 0.697 | 0.991 | 8.730 |
| 0.697 | 0.996 | 8.730 |
| 0.696 | 1.001 | 8.730 |
| 0.696 | 1.006 | 8.730 |
| 0.696 | 1.011 | 8.730 |
| 0.696 | 1.014 | 8.730 |
| 0.695 | 1.017 | 8.730 |
| 0.694 | 1.020 | 8.730 |
| 0.692 | 1.022 | 8.730 |
| 0.691 | 1.024 | 8.730 |
| 0.688 | 1.026 | 8.730 |
| 0.686 | 1.028 | 8.730 |
| 0.683 | 1.030 | 8.730 |
| 0.680 | 1.030 | 8.730 |
| 0.678 | 1.031 | 8.730 |
| 0.675 | 1.031 | 8.730 |
| 0.672 | 1.030 | 8.730 |

TABLE 2-continued

| X | Y | Z |
|---|---|---|
| 0.669 | 1.029 | 8.730 |
| 0.666 | 1.028 | 8.730 |
| 0.664 | 1.026 | 8.730 |
| 0.662 | 1.023 | 8.730 |
| 0.660 | 1.021 | 8.730 |
| 0.659 | 1.018 | 8.730 |
| 0.658 | 1.015 | 8.730 |
| 0.657 | 1.012 | 8.730 |
| 0.656 | 1.008 | 8.730 |
| 0.655 | 1.004 | 8.730 |
| 0.654 | 1.000 | 8.730 |
| 0.653 | 0.997 | 8.730 |
| 0.652 | 0.993 | 8.730 |
| 0.651 | 0.989 | 8.730 |
| 0.650 | 0.985 | 8.730 |
| 0.649 | 0.981 | 8.730 |
| 0.648 | 0.978 | 8.730 |
| 0.643 | 0.959 | 8.730 |
| 0.638 | 0.940 | 8.730 |
| 0.633 | 0.921 | 8.730 |
| 0.628 | 0.903 | 8.730 |
| 0.622 | 0.884 | 8.730 |
| 0.617 | 0.865 | 8.730 |
| 0.611 | 0.847 | 8.730 |
| 0.605 | 0.828 | 8.730 |
| 0.599 | 0.810 | 8.730 |
| 0.593 | 0.791 | 8.730 |
| 0.586 | 0.773 | 8.730 |
| 0.580 | 0.754 | 8.730 |
| 0.573 | 0.736 | 8.730 |
| 0.566 | 0.718 | 8.730 |
| 0.559 | 0.700 | 8.730 |
| 0.551 | 0.682 | 8.730 |
| 0.543 | 0.664 | 8.730 |
| 0.536 | 0.646 | 8.730 |
| 0.528 | 0.628 | 8.730 |
| 0.520 | 0.611 | 8.730 |
| 0.512 | 0.593 | 8.730 |
| 0.503 | 0.575 | 8.730 |
| 0.495 | 0.558 | 8.730 |
| 0.486 | 0.541 | 8.730 |
| 0.477 | 0.523 | 8.730 |
| 0.468 | 0.506 | 8.730 |
| 0.459 | 0.489 | 8.730 |
| 0.449 | 0.472 | 8.730 |
| 0.440 | 0.455 | 8.730 |
| 0.430 | 0.438 | 8.730 |
| 0.419 | 0.422 | 8.730 |
| 0.409 | 0.405 | 8.730 |
| 0.398 | 0.389 | 8.730 |
| 0.388 | 0.373 | 8.730 |
| 0.376 | 0.357 | 8.730 |
| 0.365 | 0.341 | 8.730 |
| 0.354 | 0.325 | 8.730 |
| 0.342 | 0.310 | 8.730 |
| 0.330 | 0.294 | 8.730 |
| 0.317 | 0.279 | 8.730 |
| 0.305 | 0.264 | 8.730 |
| 0.292 | 0.250 | 8.730 |
| 0.279 | 0.235 | 8.730 |
| 0.265 | 0.221 | 8.730 |
| 0.252 | 0.207 | 8.730 |
| 0.238 | 0.194 | 8.730 |
| 0.224 | 0.180 | 8.730 |
| 0.209 | 0.167 | 8.730 |
| 0.195 | 0.155 | 8.730 |
| 0.180 | 0.142 | 8.730 |
| 0.164 | 0.130 | 8.730 |
| 0.149 | 0.118 | 8.730 |
| 0.133 | 0.107 | 8.730 |
| 0.117 | 0.096 | 8.730 |
| 0.101 | 0.085 | 8.730 |
| 0.084 | 0.075 | 8.730 |
| 0.067 | 0.065 | 8.730 |
| 0.050 | 0.056 | 8.730 |
| 0.033 | 0.047 | 8.730 |
| 0.016 | 0.038 | 8.730 |
| −0.002 | 0.030 | 8.730 |

TABLE 2-continued

| X | Y | Z |
|---|---|---|
| −0.020 | 0.022 | 8.730 |
| −0.038 | 0.015 | 8.730 |
| −0.056 | 0.009 | 8.730 |
| −0.075 | 0.002 | 8.730 |
| −0.094 | −0.003 | 8.730 |
| −0.112 | −0.009 | 8.730 |
| −0.131 | −0.013 | 8.730 |
| −0.150 | −0.018 | 8.730 |
| −0.169 | −0.022 | 8.730 |
| −0.188 | −0.026 | 8.730 |
| −0.207 | −0.029 | 8.730 |
| −0.227 | −0.033 | 8.730 |
| −0.246 | −0.036 | 8.730 |
| −0.265 | −0.040 | 8.730 |
| −0.284 | −0.044 | 8.730 |
| −0.303 | −0.050 | 8.730 |
| −0.321 | −0.056 | 8.730 |
| −0.339 | −0.064 | 8.730 |
| −0.342 | −0.066 | 8.730 |
| −0.346 | −0.068 | 8.730 |
| −0.349 | −0.070 | 8.730 |
| −0.352 | −0.072 | 8.730 |
| −0.356 | −0.074 | 8.730 |
| −0.359 | −0.076 | 8.730 |
| −0.362 | −0.078 | 8.730 |
| −0.365 | −0.080 | 8.730 |
| −0.368 | −0.083 | 8.730 |
| −0.371 | −0.085 | 8.730 |
| −0.386 | −0.097 | 8.730 |
| −0.400 | −0.108 | 8.730 |
| −0.413 | −0.121 | 8.730 |
| −0.425 | −0.135 | 8.730 |
| −0.436 | −0.149 | 8.730 |
| −0.446 | −0.165 | 8.730 |
| −0.454 | −0.181 | 8.730 |
| −0.459 | −0.199 | 8.730 |
| −0.462 | −0.216 | 8.730 |
| −0.462 | −0.235 | 8.730 |
| −0.458 | −0.252 | 8.730 |
| −0.450 | −0.269 | 8.730 |
| −0.438 | −0.283 | 8.730 |
| −0.425 | −0.296 | 8.730 |
| −0.411 | −0.307 | 8.730 |
| −0.395 | −0.316 | 8.730 |
| −0.378 | −0.324 | 8.730 |
| −0.361 | −0.330 | 8.730 |

It should be understood that the finished second stage HPT vane 40*b* does not necessarily include all the sections defined in Table 2. The portion of the airfoil 54 proximal to the platforms 60 and 62 may not be defined by a profile section 66. It should be considered that the vane 40*b* airfoil profile proximal to the platforms 60 and 62 may vary due to several imposed constraints. However, the HPT vane 40*a* has an intermediate airfoil portion 64 defined between the inner and outer vane platforms 60 and 62 thereof and which has a profile defined on the basis of at least the intermediate Sections of the various vane profile sections 66 defined in Table 2.

It should be appreciated that the intermediate airfoil portion 64 of the HPT stage vane 40*b* is defined between the inner and outer gaspath walls 28 and 30 which are partially defined by the inner and outer vane platforms 60 and 62. More specifically, the Z values defining the gaspath 27 in the region of the stacking line 48 fall within the range of about 6.56 to about 8.38 inches which generally correspond to the z values around the stacking line 48 (X=2.812). The airfoil profile physically appearing on HPT vane 40*b* and fully contained in the gaspath includes Sections 5 to 11 of Table 2. The other sections are either only partially located in the gaspath or fully located outside the gaspath but are provided, in part, to fully define the airfoil surface and, in part, to improve curve-fitting of the airfoil at its radially distal portions. The skilled reader will appreciate that a suitable fillet radius is to be applied between the platforms 60 and 62 and the airfoil portion of the vane. The vane inner diameter and outside diameter endwall fillets are in the range of about 0.070" to about 0.090".

Figure 4A:
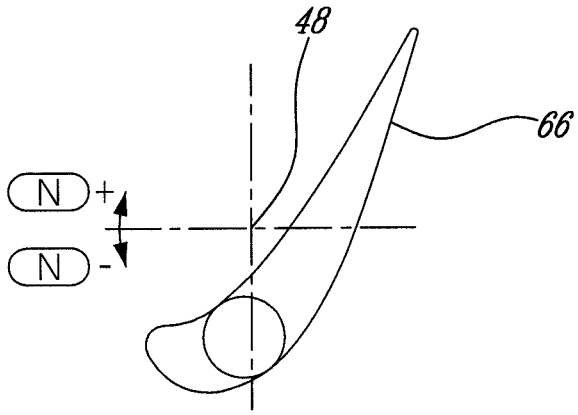
FIGS. 4*a* and 4*b* are simplified 2D HP turbine vane airfoil cross-sections illustrating the angular twist and restagger tolerances.
Figure 4B:
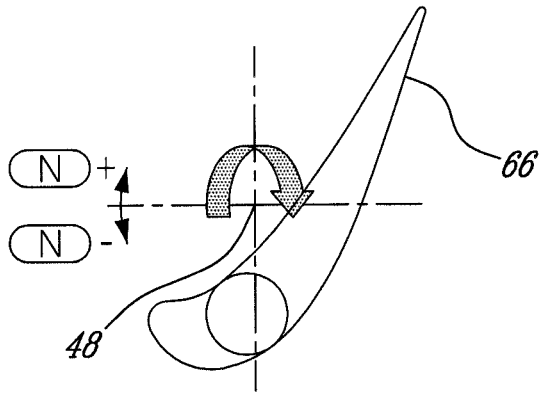

FIGS. 4*a* and 4*b* illustrate the tolerances on twist and restagger angles. The twist "N" is an angular variation at each vane section, whereas restagger is the angular reposition of the entire airfoil. Both the twist and the restagger angles are about the stacking line 48. The section twist "N" (section restagger) tolerance with respect to the stacking line is +/−0.75 degrees. The global restagger capability for the airfoil with respect to the stacking line is +/−2.00 degrees.

The above description is meant to be exemplary only, and one skilled in the art will recognize that changes may be made to the embodiments described without department from the scope of the invention disclosed. Still other modifications which fall within the scope of the present invention will be apparent to those skilled in the art, in light of a review of this disclosure, and such modifications are intended to fall within the appended claims.

The invention claimed is:

1. A turbine vane for a gas turbine engine comprising an airfoil having an intermediate portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

2. The turbine vane as defined in claim 1 forming part of a high pressure turbine stage of the gas turbine engine.

3. The turbine vane as defined in claim 2, wherein the vane forms part of a second stage of a multi-stage high pressure turbine.

4. The turbine vane as defined in claim 1, wherein the turbine vane has a manufacturing tolerance of ±0.015 inch in a direction perpendicular to the airfoil.

5. The turbine vane as defined in claim 1, wherein X and Y values define a set of points for each Z value which when connected by smooth continuing arcs define an airfoil profile section, the profile sections at the Z distances being joined smoothly with one another to form an airfoil shape of the intermediate portion.

6. A turbine vane for a gas turbine engine, the turbine vane having an intermediate airfoil portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

7. The turbine vane as defined in claim 6 forming part of a vane of a high pressure turbine stage of the gas turbine engine.

8. The turbine vane as defined in claim 7, wherein the vane is part of a second stage of a two-stage high pressure turbine.

9. The turbine vane as defined in claim 6, wherein the turbine vane has a manufacturing tolerance of ±0.015 inch.

10. The turbine vane as defined in claim 6, wherein X and Y values define a set of points for each Z value which when connected by smooth continuing arcs define an airfoil profile section, the profile sections at the Z distances being joined smoothly with one another to form an airfoil shape of the intermediate portion.

11. A turbine stator assembly for a gas turbine engine comprising a plurality of vanes, each vanes including an airfoil having an intermediate portion defined by a nominal profile substantially in accordance with Cartesian coordinate values of X, Y, and Z of Sections 5 to 11 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

12. A high pressure turbine vane comprising at least one airfoil having a surface lying substantially on the points of Table 2, the airfoil extending between platforms defined generally by at least some of the coordinate values given in Table 1, wherein a fillet radius is applied around the airfoil between the airfoil and platforms, and wherein the values of Table 2 are subject to the relevant tolerances.

* * * * *